US007806510B2

(12) United States Patent
Samoto et al.

(10) Patent No.: US 7,806,510 B2
(45) Date of Patent: Oct. 5, 2010

(54) IMAGE RECORDING APPARATUS

(75) Inventors: Kenji Samoto, Nagoya (JP); Noriyuki Kawamata, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 951 days.

(21) Appl. No.: 11/616,648

(22) Filed: Dec. 27, 2006

(65) Prior Publication Data

US 2007/0146419 A1 Jun. 28, 2007

(30) Foreign Application Priority Data

Dec. 28, 2005 (JP) ..... 2005-377526

(51) Int. Cl.
*B41J 23/00* (2006.01)

(52) U.S. Cl. ..... 347/37

(58) Field of Classification Search ..... 347/37, 347/86

See application file for complete search history.

(56) References Cited

U.S. PATENT DOCUMENTS

| | | | |
|---|---|---|---|
| 6,789,966 | B2 | 9/2004 | Tanaka et al. |
| 2005/0195242 | A1 | 9/2005 | Samoto et al. |
| 2005/0243125 | A1 | 11/2005 | Ishikawa |
| 2007/0146421 | A1 | 6/2007 | Smoto et al. |
| 2007/0165066 | A1 | 7/2007 | Samoto et al. |

FOREIGN PATENT DOCUMENTS

| | | | |
|---|---|---|---|
| JP | 5270091 | A | 10/1993 |
| JP | H5270091 | | 10/1993 |
| JP | 2002254746 | | 9/2002 |
| JP | 2002254746 | A | 9/2002 |
| JP | 2005246907 | | 9/2005 |
| JP | 2005246907 | A | 9/2005 |
| JP | 2005313492 | | 11/2005 |
| JP | 2005313492 | A | 11/2005 |
| JP | 2007176022 | A | 7/2007 |
| JP | 2007176023 | A | 7/2007 |

*Primary Examiner*—Shih-Wen Hsieh
(74) *Attorney, Agent, or Firm*—Baker Botts L.L.P.

(57) ABSTRACT

An image recording apparatus comprises a carriage carrying a recording head for recording an image on a recording medium transported in a predetermined direction, first and second support members, disposed on an upstream side and a downstream side, respectively, in a transport direction of the recording medium, for supporting said carriage slidably by support surfaces thereof facing said recording head and an endless belt for moving said carriage reciprocally in a direction substantially orthogonal to the transport direction wherein said carriage comprises a first contact section that comes into contact with the support surface of said first support member, and a second contact section that comes into contact with the support surface of said second support member, and a height position of a joint section of said endless belt and said carriage is at substantially the same height as a position of center of gravity of said carriage.

16 Claims, 15 Drawing Sheets

IMAGE RECORDING APPARATUS

CROSS-REFERENCE TO RELATED APPLICATION

This non-provisional application claims priority under 35 U.S.C. §119(a) on Patent Application No. 2005-377526 filed in Japan on Dec. 28, 2005, the entire contents of which are hereby incorporated by reference.

BACKGROUND OF THE INVENTION

1. Field of the Invention

The present invention relates to an inkjet type image recording apparatus, and more specifically relates to the structure of a device for supporting a carriage carrying a recording head.

2. Description of Related Art

An example of the mainstream structures of conventional image recording apparatuses is the structure disclosed in Japanese Patent Application Laid-Open No. 5-270091 (1993) in which a carriage carrying a recording head is slidably supported by a guide shaft in the shape of a round shaft so that the carriage is movable reciprocally along the main scanning direction (hereinafter referred to as the "X-axis direction", the X axis representing an axis extending in the main scanning direction).

Since the guide shaft in the shape of a round shaft has good dimensional precision and high rigidity, it is capable of decreasing the variation in a so-called paper gap from the nozzle surface of the recording head to the surface of a recording medium, and has the advantage of readily providing high-quality recorded images. However, this structure has the disadvantage of high costs including the frame structure, and also has the problem that it is very difficult to mount the carriage because it is necessary to first detach the guide shaft from the frame and then remove the carriage from the guide shaft when removing the carriage from the guide shaft, and it is necessary to execute the reverse procedure when mounting the carriage.

As a prior art for solving the above-mentioned problems, Japanese Patent Applications Laid-Open Nos. 2002-254746 and 2005-313492 disclose the structures in which the plate-like first guide member and second guide member are arranged lengthwise in the main scanning direction on the upstream side and downstream side of a plate-like platen in a paper transport direction (a sub-scanning direction orthogonal to the main-scanning direction (hereinafter referred to as the "Y-axis direction", the Y axis representing an axis extending in the sub-scanning direction), a recording head is provided on the lower surface of a carriage supported slidably over the first and second guide members, and the carriage is connected to a part of an endless belt placed lengthwise in the main scanning direction so that it is moved reciprocally by a carriage drive motor.

Provided on the lower surface of the carriage is a guide section (slidable projection section) that comes into contact with a slide surface formed on the upper surface of each of the first and second guide members to control a print gap (paper gap) between the recording head of the carriage and paper on the platen. Moreover, on the guide member located closer to a position including the joint section with respect to the endless belt (the second guide member located on the downstream side), a carriage guide plate is formed to stand in a vertical direction (the Z-axis direction orthogonal to the X axis and the Y axis) so that, when the carriage is pulled and moved by the endless belt, the orientation of the carriage does not turn about the vertical (perpendicular) axis (hereinafter referred to as the Z axis).

The carriage disclosed in Japanese Patent Application Laid-Open No. 2002-254746 includes an ink cartridge. On the other hand, in an inkjet printer disclosed in Japanese Patent Application Laid-Open No. 2005-313492, an ink cartridge is placed in a stationary manner in the main body housing of a printer apparatus, and the ink cartridge and the carriage are joined with an ink supply tube.

By the way, as shown in Japanese Patent Application Laid-Open No. 2005-313492, a drive pulley is attached to a carriage motor (CR motor) fixed to the frame of the apparatus main body or one end of the second guide member in the main scanning direction, and a driven pulley is rotatably attached to the other end in the main scanning direction. The drive pulley and the driven pulley have a flange section formed to prevent the endless belt wound around these pulleys from being displaced in the axial direction of the pulleys.

However, at the initial stage at which the carriage is started moving along the main scanning direction (X-axis direction), that is, when acceleration is given to the carriage, a moment to rotate the carriage about an axis (Y axis) in the sub-scanning direction through the center of gravity acts. Thus, the posture of the carriage during an image recording operation is unstable, and the accuracy of the above-mentioned paper gap (hereinafter referred to as the "PG") becomes unstable and causes problems that the quality of images to be recorded may be deteriorated or unstable.

Moreover, in the second guide member disclosed in Japanese Patent Application Laid-Open No. 2005-313492, since the slide surface for supporting the carriage (namely, a surface for controlling the gap dimension (PG) between the nozzle surface of the recording head and the platen), a reference surface with respect to the heights of the CR motor, drive pulley, driven pulley, etc., and a reference surface for the mount surface of a maintenance mechanism are substantially level with each other, it was impossible to adjust the height position of center of gravity of the carriage in the vertical (Z-axis) direction and the pulled height position of the endless belt (the height position of the belt joint section) to the most stable positions in the Z-axis direction.

BRIEF SUMMARY OF THE INVENTION

The present invention has been made with the aim of solving the above problems, and it is an object of the present invention to provide an image recording apparatus which is constructed to facilitate the operation of attaching/detaching a carriage, enable a reduction in the manufacturing costs, and stabilize the posture of the carriage about a sub-scanning direction (the Y axis), without using a guide shaft.

An image recording apparatus according to a first aspect of the invention is characterized by comprising: a carriage carrying a recording head for recording an image on a recording medium transported in a predetermined direction; first and second support members, disposed on an upstream side and a downstream side, respectively, in a transport direction of the recording medium, for supporting the carriage slidably by support surfaces thereof facing the recording head; and an endless belt, jointed to the carriage, for moving the carriage reciprocally in a direction substantially orthogonal to the transport direction, wherein the carriage comprises a first contact section that comes into contact with the support surface of the first support member, and a second contact section that comes into contact with the support surface of the second support member, and a height position of a joint section of the endless belt and the carriage is at substantially the same height as a position of center of gravity of the carriage.

An image recording apparatus according to a second aspect of the invention is based on the image recording apparatus of the first aspect of the invention, and characterized in that the position of center of gravity of the carriage is present within a width of the endless belt.

An image recording apparatus according to a third aspect of the invention is based on the image recording apparatus of the first aspect of the invention, and characterized in that the second support member has a mount section for mounting the endless belt, and the height position of the joint section of the endless belt and the carriage is higher than the mount section.

An image recording apparatus according to a fourth aspect of the invention is based on the image recording apparatus of the third aspect of the invention, and characterized in that the second support member has the mount sections at two positions spaced from each other in a moving direction of the carriage.

An image recording apparatus according to a fifth aspect of the invention is based on the image recording apparatus of the first aspect of the invention, and characterized in that the second contact sections are provided at two positions spaced from each other in a moving direction of the carriage, and the joint section of the endless belt and the carriage is located between the two second contact sections.

An image recording apparatus according to a sixth aspect of the invention is based on the image recording apparatus of the fifth aspect of the invention, and characterized in that height positions of the two second contact sections and the position of center of gravity of the carriage are at substantially the same height.

An image recording apparatus according to a seventh aspect of the invention is based on the image recording apparatus of the first aspect of the invention, and characterized by further comprising a support piece, provided on the second support member on the downstream side in the transport direction so that it stands substantially orthogonally to the support surface of the second support member, wherein the carriage comprises a third contact section that comes into contact with one surface of the support piece, a fourth contact section that comes into contact with the other surface of the support piece at an opposite position to the third contact section, and a resilient member for pressing the fourth contact section toward the third contact section, and the joint section of the endless belt and the carriage is located between the second contact section and the third contact section in the transport direction.

An image recording apparatus according to an eighth aspect of the invention is based on the image recording apparatus of the seventh aspect of the invention, and characterized in that two pairs of the third and fourth contact sections are arranged with a suitable distance therebetween in the moving direction of the carriage.

An image recording apparatus according to a ninth aspect of the invention is based on the image recording apparatus of the first aspect of the invention, and characterized in that the height position of the support surface of the second support member is located within a width of the endless belt.

An image recording apparatus according to a tenth aspect of the invention is based on the image recording apparatus of the first aspect of the invention, and characterized by further comprising: an ink storing section for storing ink; and a flexible ink supply tube for supplying the ink in the ink storing section to the recording head, wherein the carriage has a connection section with respect to the ink supply tube to enable supply of the ink from the ink supply tube, which is connected to the connection section, to the recording head, and the connection section is located between the first contact section and the second contact section in the transport direction.

An image recording apparatus according to an eleventh aspect of the invention is based on the image recording apparatus of the tenth aspect of the invention, and characterized in that the ink storing section is capable of storing inks of a plurality of colors, and includes the same number of the ink supply tubes as the number of colors of inks stored in the ink storing section.

An image recording apparatus according to a twelfth aspect of the invention is based on the image recording apparatus of the seventh aspect of the invention, and characterized by further comprising: an ink storing section for storing ink; and a flexible ink supply tube for supplying the ink in the ink storing section to the recording head, wherein the carriage has a connection section with respect to the ink supply tube to enable supply of the ink from the ink supply tube, which is connected to the connection section, to the recording head, and the connection section is located between the first contact section and the second contact section in the transport direction.

An image recording apparatus according to a thirteenth aspect of the invention is based on the image recording apparatus of the twelfth aspect of the invention, and characterized in that the connection section is located between the second contact section and the third contact section in the transport direction.

An image recording apparatus according to a fourteenth aspect of the invention is based on the image recording apparatus of the twelfth aspect of the invention, and characterized in that the ink storing section is capable of storing inks of a plurality of colors, and includes the same number of the ink supply tubes as the number of colors of inks stored in the ink storing section.

An image recording apparatus according to a fifteenth aspect of the invention is based on the image recording apparatus of the fifth aspect of the invention, and characterized in that the first contact section and the two second contact sections are positioned on vertexes of a triangle straddled over the first and second support members.

An image recording apparatus according to a sixteenth aspect of the invention is based on the image recording apparatus of the first aspect of the invention, and characterized in that the first and second support members are connected with a pair of side plates extending in the transport direction, and at least one side of the second support member is extended to the outside of the side plate along the moving direction of the carriage.

An image recording apparatus according to a seventeenth aspect of the invention is based on the image recording apparatus of the sixteenth aspect of the invention, and characterized in that a platen facing the recording head is provided between the pair of side plates.

According to the first aspect of the invention, since the first contact section and second contact section of the carriage come into contact with the support surfaces formed on the first and second support members, the carriage is movable in the main scanning direction while being supported on the support members by its own weight.

According to the second aspect of the invention, when the carriage starts moving in the main scanning direction, or even when the carriage receives the influence of acceleration, a moment about an axis passing through the position of center of gravity of the carriage and parallel to the paper transport direction can be received by the support surface of the second support member. As a result, it is possible to ensure stable movement of the carriage in the main scanning direction against torque of the carriage about the axis.

According to the third aspect of the invention, the height of the joint section of the endless belt and the carriage is set higher than the mount position of the endless belt with respect to the second support member. Therefore, when the carriage starts moving in the main scanning direction, or when the carriage moves from a stationary state by receiving acceleration, a component force in a vertical direction of the tension of the endless belt acts on the carriage at the joint section of the carriage and the belt. In this case, the torque trying to rotate the carriage about an axis parallel to the paper transport direction due to the component force can be efficiently received by the second contact section and the support surface. As a result, it is possible to reduce the change in the posture of the carriage about the axis, and it is possible to ensure stable movement of the carriage in the main scanning direction.

According to the fourth aspect of the invention, the second support member has mount sections at two positions located with a suitable distance therebetween in the moving direction of the carriage. Thus, since the second support member can perform both the function of supporting the carriage and the function of mounting the endless belt, it is possible to decrease the cost and reduce the sizes of the recording section and the entire apparatus.

According to the fifth aspect of the invention, the joint section of the carriage and the belt is positioned between the two second contact sections. Therefore, the first contact section and second contact section can efficiently receive a force trying to rotate the carriage about an axis parallel to the paper transport direction due to the function of a component force in a vertical direction produced by the endless belt particularly when the carriage starts moving in the main scanning direction, or when the carriage moves from a stationary state by receiving acceleration. As a result, it is possible to prevent a change in the posture of the carriage about the axis, and it is possible to ensure stable movement of the carriage in the main scanning direction.

According to the sixth aspect of the invention, the heights of the two second contact sections and the height of the center of gravity of the carriage are of the same height. It is thus possible to make as small as possible the torque trying to rotate the carriage about an axis parallel to the paper transport direction due to an inertia force of accelerated movement of the carriage and the tension of the endless belt. Moreover, since the second contact section provided on the carriage comes into contact with the support surface of the second support member, it is possible to receive the torque trying to rotate the carriage about the axis, thereby preventing a change in the posture of the carriage about the axis and ensuring stable movement of the carriage in the main scanning direction.

According to the seventh aspect of the invention, the carriage comprises the third contact section that comes into contact with one surface of the support piece standing on the second support member, the fourth contact section that comes into contact with the other surface, and the resilient member for energizing the fourth contact section toward the third contact section, and the joint section of the endless belt and the carriage is located between the second contact section and the third contact section in the transport direction. Thus, since the third contact section provided on the carriage comes into contact with the support piece in the vertical direction, it is possible to receive the torque trying to rotate the carriage about an axis passing through the joint section of the belt and parallel to the carriage due to the tension of the endless belt, thereby preventing a change in the posture of the carriage about the axis and ensuring stable movement of the carriage in the main scanning direction.

According to the eighth aspect of the invention, two pairs of the third and fourth contact sections are arranged with a suitable distance therebetween in the moving direction of the carriage. Thus, since the two pairs of the third and fourth contact sections come into contact with the support piece in the vertical direction, it is possible to efficiently receive the torque trying to rotate the carriage about an axis parallel to the carriage, thereby preventing a change in the posture of the carriage about the axis and ensuring stable movement of the carriage in the main scanning direction.

According to the ninth aspect of the invention, the height of the support surface of the second support member is within the width of the endless belt. Thus, it is possible to make as small as possible the torque trying to rotate the carriage about an axis passing through the joint section of the belt and parallel to the paper transport direction due to the tension of the endless belt. Moreover, since the second contact section provided on the carriage comes into contact with the support surface of the second support member, it is possible to receive the torque trying to rotate the carriage about the axis, thereby reducing the change in the posture of the carriage about the axis and ensuring stable movement of the carriage in the main scanning direction.

According to the tenth and twelfth aspects of the invention, the connection section to the ink supply tube on the carriage is positioned between the first contact section and the second contact section in the paper transport direction. The load applied to the connection section by the ink supply tube can be supported by the support surface of the second support member with which the second contact section comes into contact. As a result, it is possible to prevent a change in the posture of the carriage about the axis parallel to the moving direction of the carriage, and it is possible to ensure stable movement of the carriage in the main scanning direction.

According to the eleventh and fourteenth aspects of the invention, the image recording apparatus includes the same number of the ink supply tubes as the number of the colors of inks stored in the ink storing sections. Therefore, even when a large load is applied to the connection section on the carriage, it is possible to support the load by the support surface of the second support member with which the second contact section come into contact. As a result, it is possible to prevent a change in the posture of the carriage about the axis parallel to the moving direction of the carriage, and it is possible to ensure stable movement of the carriage in the main scanning direction.

According to the thirteenth aspect of the invention, the connection section provided on the carriage for the ink supply tube is positioned between the second contact section and the third contact section. In other words, since the contact section is positioned in the third contact section near the joint section of the endless belt, a moment about an axis parallel to the moving direction of the carriage produced by the load applied by the connection of the ink supply tube can also be supported by the second contact section and third contact section. As a result, it is possible to prevent a change in the posture of the carriage about the axis, and it is possible to ensure stable movement of the carriage in the main scanning direction.

According to the fifteenth aspect of the invention, the first contact section and two second contact sections are provided on the vertexes of a triangle stretched over the first and second support members. Therefore, a force trying to rotate the carriage about an axis parallel to the paper transport direction due to the function of a component force in the main scanning direction produced by the endless belt when the carriage starts moving in the main scanning direction, or when the carriage moves from a stationary state by receiving acceleration, can be efficiently received by a pair of the second contact sections located with a suitable distance therebetween and the support surface of the second support member. As a result, it is possible to prevent a change in the posture of the carriage about the axis, and it is possible to ensure stable movement of the carriage in the main scanning direction.

According to the sixteenth aspect of the invention, the lower surfaces of the first support member and the second support members are joined with a pair of side plates extending in a sub-scanning direction, and at least one side of the second support member is extended to the outside of the side plate along the main scanning direction. Therefore, when moving the carriage along the main scanning direction, it is possible to move the carriage to a position where a part of the carriage has crossed at least one side plate. In addition, it is possible to place necessary components such as a gear in the space between the external surface of the one side plate and the lower surface of the part of the second support member moved to the outside of the side plate, and it is possible to reduce the dimension in the left-to-right direction of the entire recording section while increasing the movable distance of the carriage in the main scanning direction.

According to the seventeenth aspect of the invention, since the platen facing the nozzle surface of the recording head is placed between one pair of side plates, it is possible to reduce the size of the image recording apparatus while increasing the movable distance of the carriage in the main scanning direction.

The above and further objects and features of the invention will more fully be apparent from the following detailed description with accompanying drawings.

DETAILED DESCRIPTION OF THE INVENTION

The following description will explain in detail the present invention, based on the drawings illustrating an embodiment thereof.

Figure 1:
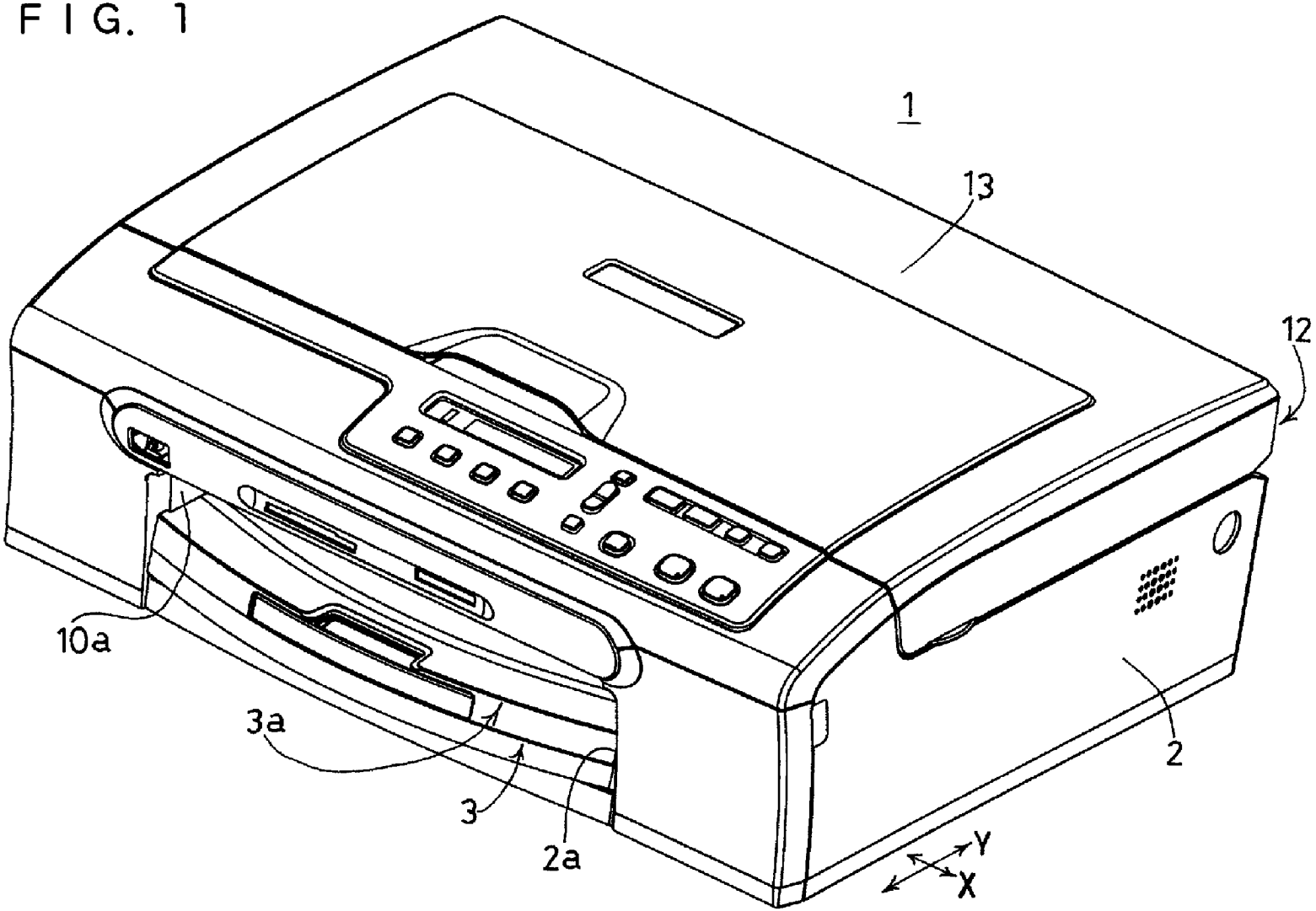
FIG. 1 is an overall perspective view of an image recording apparatus according to an embodiment.

FIG. 1 is an overall perspective view of an image recording apparatus according to this embodiment. In FIG. 1, 1 represents an image recording apparatus of this embodiment that is a multi function device (MFD) having a printer function, a copy function, a scanner function and a facsimile function. The image recording apparatus 1 of this embodiment comprises a recording apparatus main body 2 made of a synthetic resin, and an insertable paper feed cassette 3 in an opening 2*a* formed in the recording apparatus main body 2. A side of the apparatus where the opening 2*a* is formed is hereinafter referred to as the front side, and the left and right sides and rear side of the apparatus are defined based on this side.

In the paper feed cassette 3, paper cut in a size, such as, for example, A4 size, letter size, legal size and postcard size, is stored as a recording medium. A plurality of sheets of paper to be stored are placed one on the other so that the short sides are arranged in a direction (hereinafter also referred to as a main scanning direction or the X-axis direction) substantially orthogonal to a paper transport direction (hereinafter also referred to as a sub-scanning direction or the Y-axis direction).

An auxiliary paper feed cassette 3*a* for piling up a plurality of sheets of small-sized paper and supplying the paper is mounted on the paper feed cassette 3 so that it is movable in the Y-axis direction. FIG. 1 shows a state in which the auxiliary paper feed cassette 3*a* is pushed into a position where it does not stick out of the recording apparatus main body 2.

Provided on the upper side of the recording apparatus main body 2 are an image reading device 12 for reading a document with the copy function and the facsimile function, and an operation panel 14 including various kinds of operation buttons for accepting operations given by a user and a liquid crystal display section for displaying information to be given to the user. Further, a glass plate (not shown) capable of placing a document thereon by opening a document cover body 13 upward is provided on the upper surface of the image reading device 12, and an image scanner device (not shown) having a CIS (Contact Image Sensor) for reading a document is provided under the glass plate. The CIS is constructed so that it is movable reciprocally in the X-axis direction shown in FIG. 1.

Figure 2:
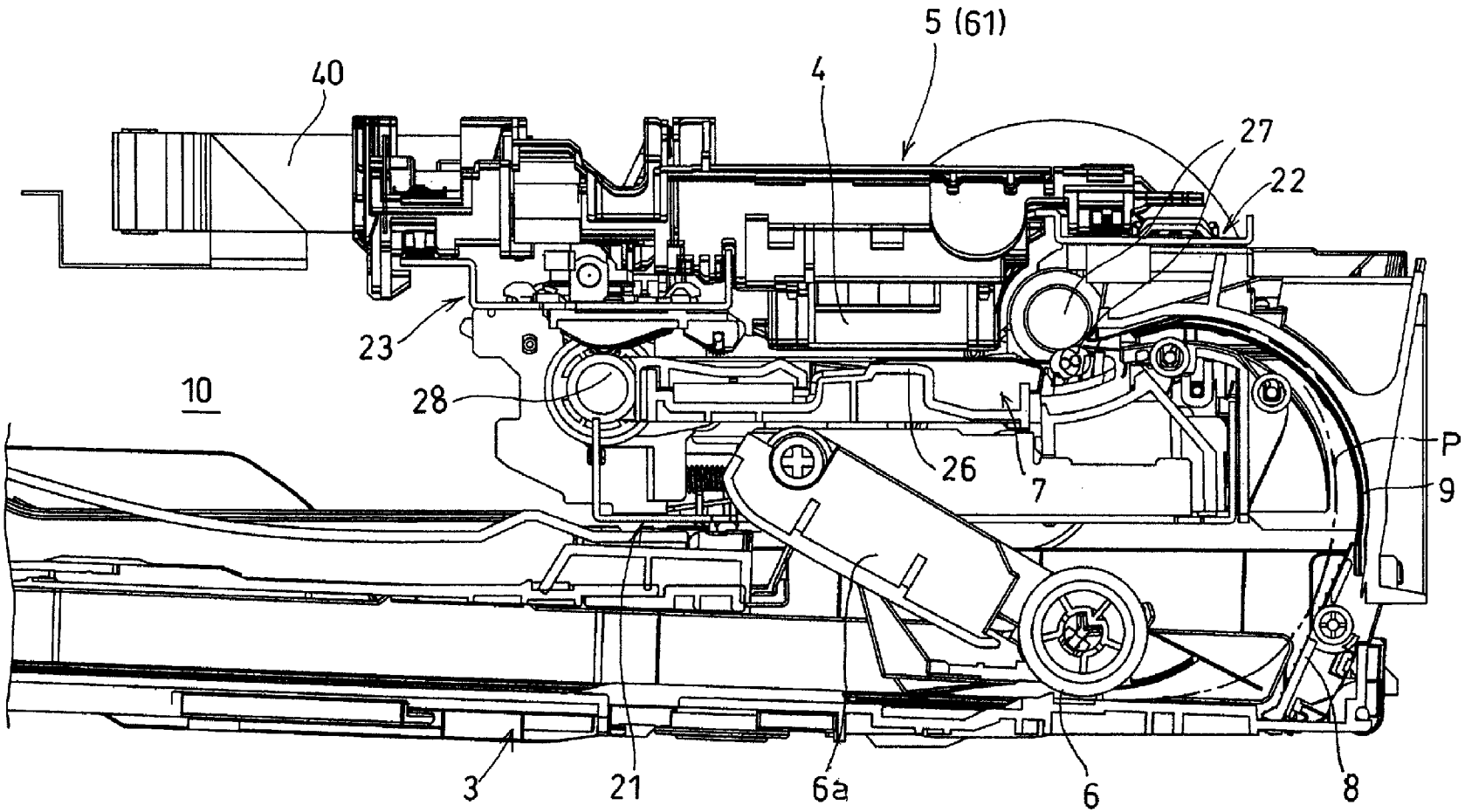
FIG. 2 is a sectional side view of the image recording apparatus.

FIG. 2 is a sectional side view of the image recording apparatus 1. A bank section for paper separation is provided on the back side (the right side in FIG. 2) of the paper feed cassette 3. An arm 6*a* having an upper end movable in an up-and-down direction is attached to the recording apparatus main body 2. With a paper feed roller 6 attached to the lower end of the arm 6*a* and a tilted separator 8, one sheet of paper is separated at a time from a pile of paper P on the paper feed cassette 3, or the auxiliary paper feed cassette 3*a*, and transported. The separated paper P is fed along a paper feed path 9 having a substantially transverse U-shape in cross section, and transported to a recording section 7 provided on the upper back side of the paper feed cassette 3. As will be described in detail later, the recording section 7 comprises a carriage 5 carrying an inkjet type recording head 4 for realizing the printer function, etc.

A pair of resist rollers 27 and 27 is provided on the upstream side of the recording section 7 in the paper transport direction. When the paper P on which an image is to be recorded is transported from the recording section 7, the resist rollers 27 and 27 hold the paper P temporarily, resume the transport of paper P after adjusting the timing of recording the image, and send the paper P to the space between a nozzle surface formed on the lower surface of the recording head 4 and a platen 26.

The recording paper P on which the image is recorded in the recording section 7 is discharged with the recorded surface facing up to a paper discharge section 10. The paper discharge section 10 is formed on the upper side of the auxiliary paper feed cassette 3*a*, and a paper discharge opening connected to the paper discharge section 10 is open toward the front side of the recording apparatus main body 2.

Figure 3:
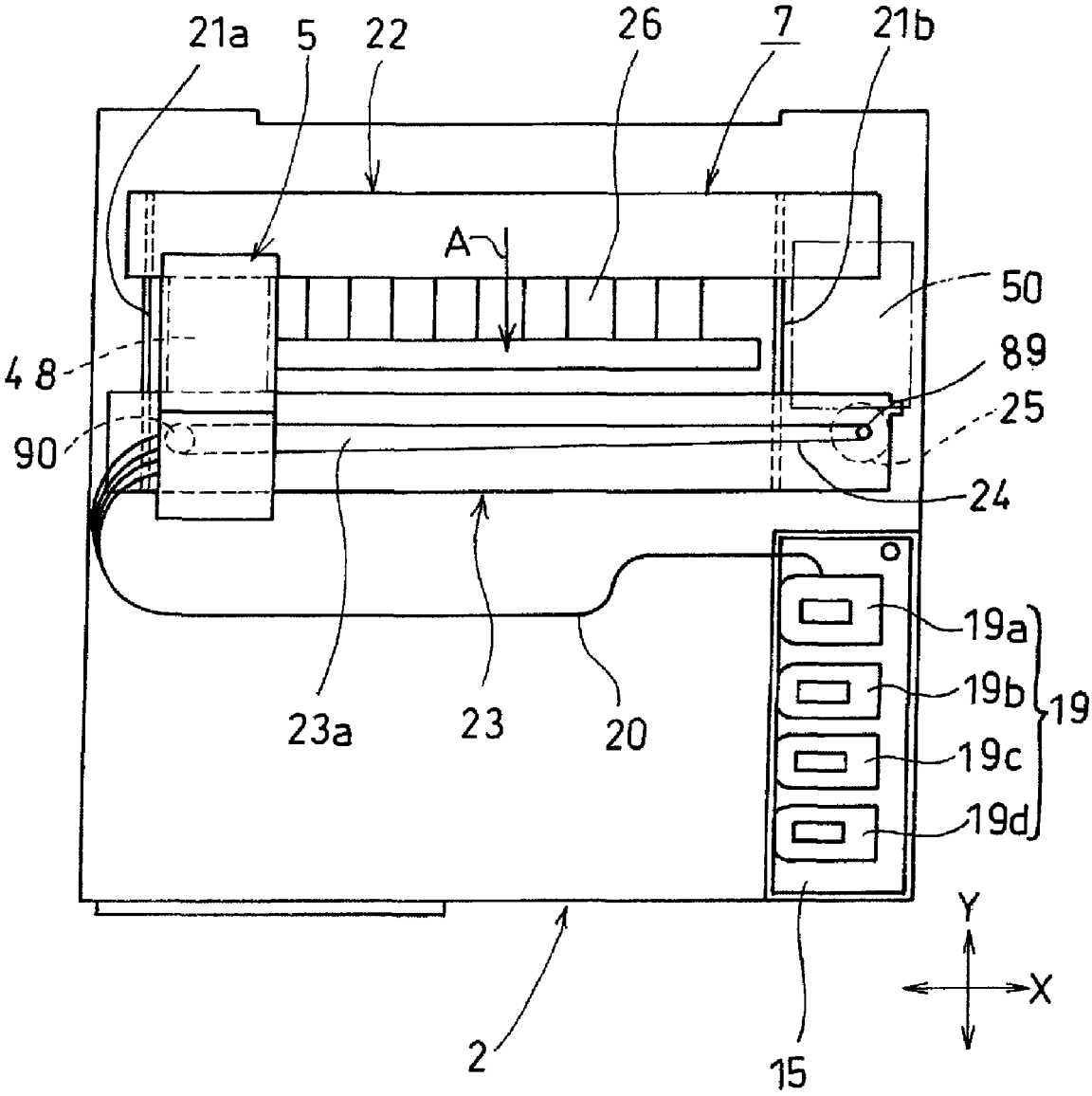
FIG. 3 is a plan view for explaining a schematic structure of the image recording apparatus.

FIG. 3 is a plan view for explaining a schematic structure of the image recording apparatus 1. An ink storing section 15 for storing ink for image recording is provided on one side of the front side of the recording apparatus main body 2. The ink storing section 15 is open toward the top of the recording apparatus main body 2, and has ink cartridges 19*a* to 19*d* storing inks of four colors, respectively, for full color recording. The colors of the inks stored in the ink cartridges 19*a* to 19*d* correspond to black (BK), cyan (C), magenta (M), and yellow (Y), respectively. As shown in FIG. 3, the cartridges 19*a* to 19*d* are stored in one line along the Y-axis direction in the ink storing section 15, and are detachable from the upper side.

Ink supply tubes 20*a* to 20*d* are connected to the ink cartridges 19*a* to 19*d*, respectively, to supply the inks of the respective colors to the recording head 4 through the ink supply tubes 20*a* to 20*d*.

Note that the ink cartridges 19*a* to 19*d* and the ink supply tubes 20*a* to 20*d* will be hereinafter stated collectively as the ink cartridges 19 and the ink supply tubes 20 unless it is necessary to specify a cartridge and an ink supply tube of a particular color. This embodiment illustrates a structure where the ink cartridges 19 corresponding to four colors are installed in the ink storing section 15. However, in the case of using more than four color inks, the ink cartridges corresponding to the number of colors of ink may be stored in the ink storing section 15, and the ink supply tubes may also be increased according to the number of the ink cartridges.

The recording section 7 is supported by a pair of left and right side plates 21*a* and 21*b* of a main frame in the form of a frame with an open top, and comprises a first guide member (first support member) 22 and a second guide member (second support member) 23 in the shape of a horizontally long plate extending in the X-axis direction in FIG. 3, and a carriage 5 which is slidably supported and reciprocally movable over the two guide members 22 and 23. The first and second guide members 22 and 23 are connected with a pair of left and right side plates 21*a* and 21*b* on the lower side. In order to reciprocally move the carriage 5 carrying the recording head 4 in the main scanning direction (X-axis direction), a timing belt 24 as an endless belt placed parallel to the second guide member 23, and a carriage motor 25 for driving the timing belt 24 are provided on the upper surface of the second guide member 23. In this embodiment, although a DC motor is used as the carriage motor 25, it may be possible to use other motor such as a stepping motor.

The timing belt 24 is wound around a drive pulley 89 attached to the drive shaft of the carriage motor 25 and a driven pulley 90 that follows the movement of the drive pulley 89. The drive pulley 89 and driven pulley 90 are arranged on the upper surface of a horizontal wide piece 23*a* of the second guide member 23 at both ends in the main scanning direction. With this arrangement, the second guide member 23 can perform both the function of slidably supporting the carriage 5 and the function of mounting moving means such as the carriage motor 25, drive pulley 89, and driven pulley. Hence, this arrangement enables a decrease in the costs, and also produces the effect of reducing the sizes of the recording head 7 and the entire apparatus.

An ink receiving section 48 is arranged on one end (the right side of the side plate 21*a* in FIG. 3) outside the width of paper (short side of paper) to be transported, and a maintenance unit 50 is arranged on the other end (the right side of the side plate 21*b*). Thus, the recording head 4 can periodically perform ink ejection for preventing clogging of the nozzle during a recording operation at a flushing position provided in the ink receiving section 48, and receive the ink in the ink receiving section 48. The maintenance unit 50 is placed at a standby position of the carriage 5, and performs a process of selectively absorbing the ink for each color, and a recovery process for removing bubbles in a buffer tank, not shown, on the recording head 4. Further, the maintenance unit 50 has a wiper, not shown, and cleans the nozzle surface formed on the lower surface of the recording head 4 when moving the carriage 5 from the standby position in the direction of an image recording area.

The plate-like platen 26 for supporting the paper to be transported is provided under the recording head 4. The above-mentioned first guide member 22 is arranged on the upstream side in the transport direction (the direction shown by arrow A in FIG. 3) of paper passing through the platen 26, and the second guide member 23 is placed on the downstream side. Moreover, a pair of resist rollers 27 and 27 is provided on the upstream side of the platen 26 in the paper transport direction, and sends the transported paper to the space between the nozzle surface formed on the lower surface of the recording head 4 and the platen 26. A spur 28*b* that comes into contact with the upper surface of the paper and a driving discharge roller 28*a* on the lower side are provided on the downstream side of the platen 26 in the paper transport direction (see FIG. 7), and the recorded paper is transported to the paper discharge section 10.

Figure 4:
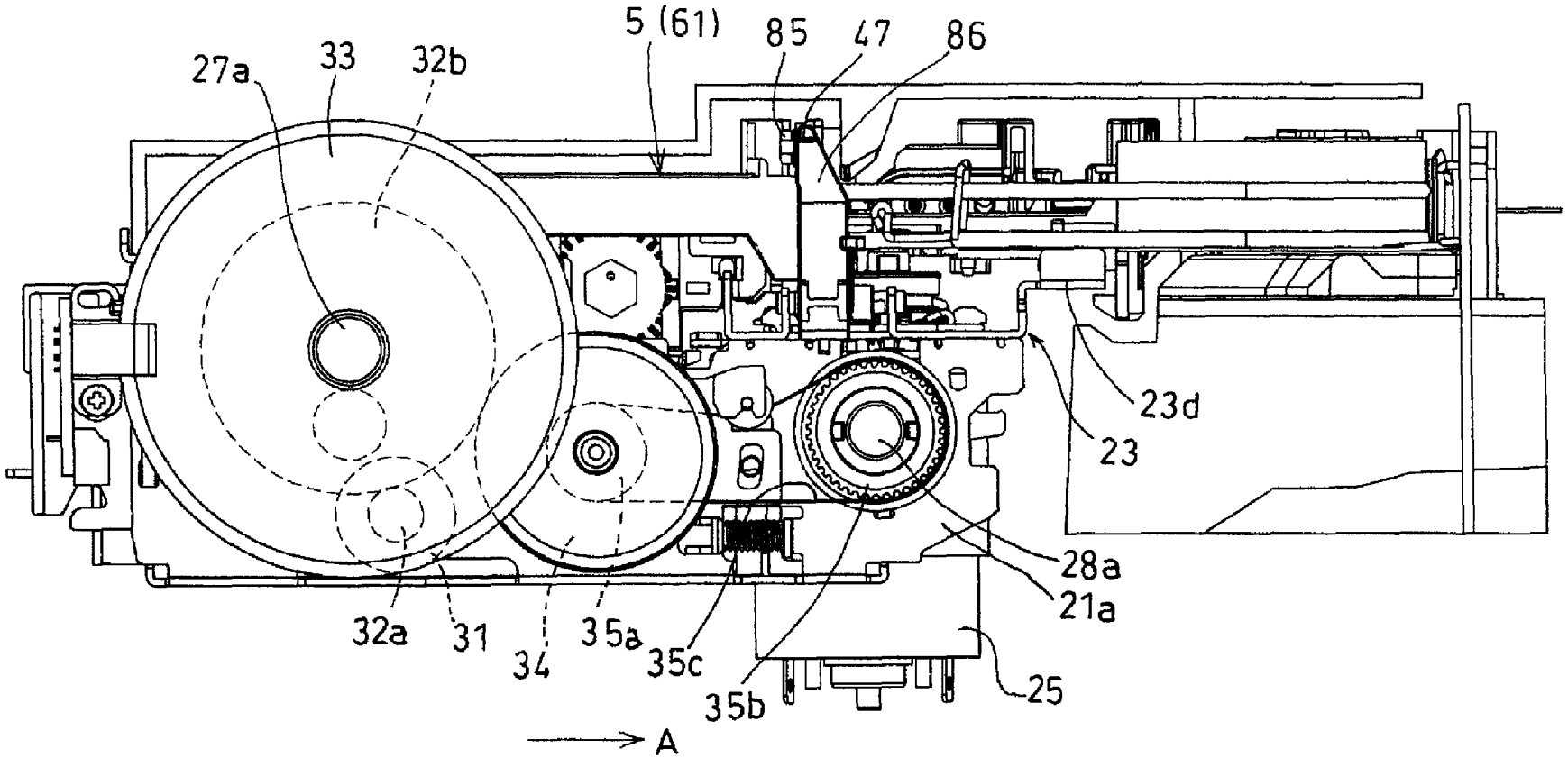
FIG. 4 is a schematic view for explaining the structure of a drive system for transporting paper.

FIG. 4 is a schematic view for explaining the structure of a drive system for transporting paper. The drive shaft (not shown) of a drive motor 31 for paper transport, which is fixed to the inner surface of the left side plate 21*a*, protrudes from the external surface of the left side plate 21*a*. Power is transmitted from a pinion gear 32*a* attached to the drive shaft to a first gear 32*b* coaxially and directly connected to a drive roller 27*a* of a pair of resist rollers 27 and 27. A large-diameter rotary encoder detection disk 33 is provided on the drive roller 27*a*, and the top of the rotary encoder detection disk 33 protrudes upward from the top surface of the left side plate 21*a*. An endless timing belt 35*c* is wound around a first pulley 35*a*, which is coaxially and directly connected to an intermediate gear 34 meshing with the first gear 32*b*, and a second pulley 35*b* attached to a paper discharge roller 28*a*. Moreover, the diameter of the second pulley 35*b* is made smaller compared to a conventional pulley so that the second pulley 35*b* is stored in the space between the external surface of the left side plate 21*a* and the lower surface of the second guide member 23 and that the dimension in the left-to-right direction of the overall recording section is decreased.

Figure 5:
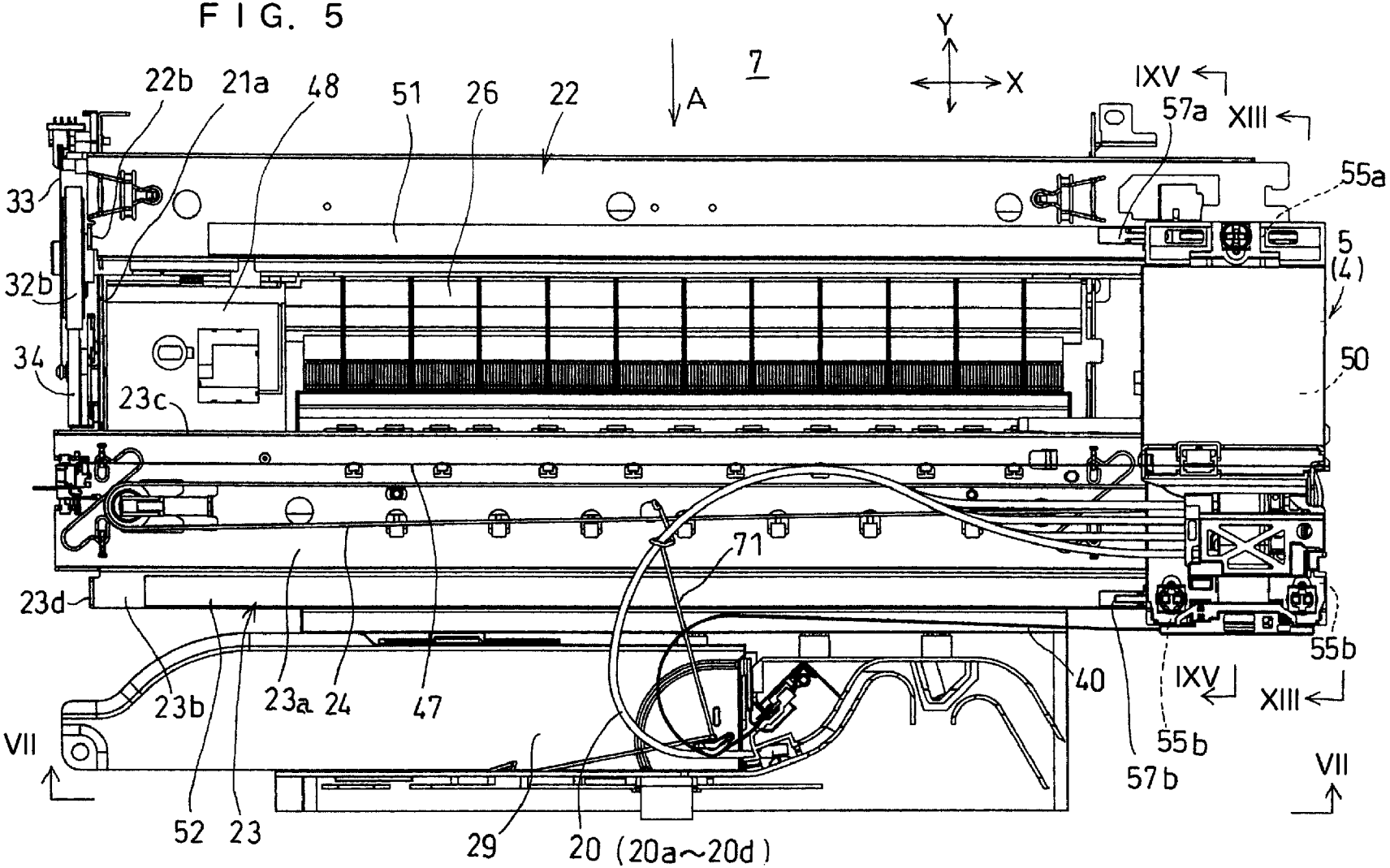
FIG. 5 is a plan view of a recording section.
Figure 6:
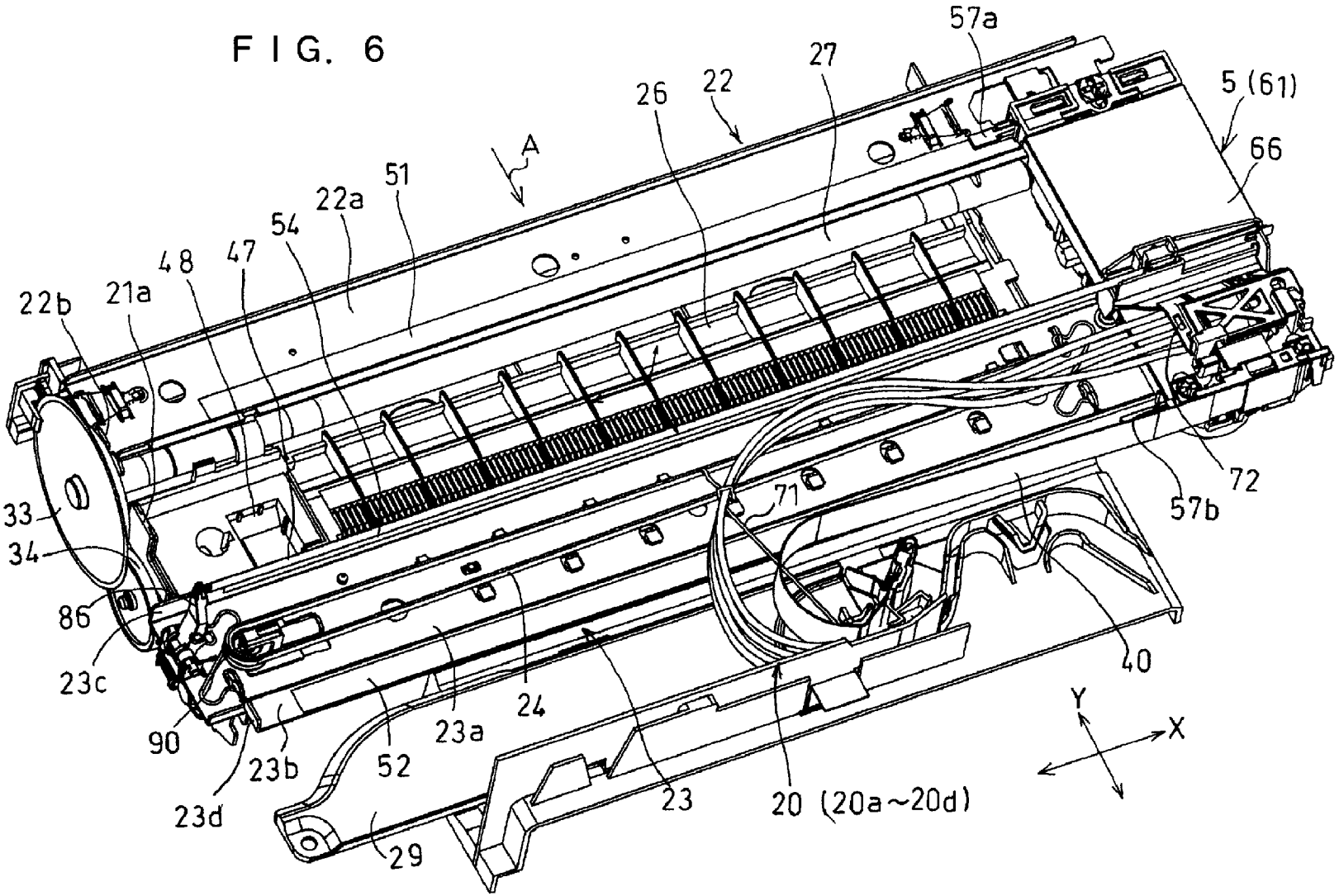
FIG. 6 is a perspective view of the recording section.
Figure 7:
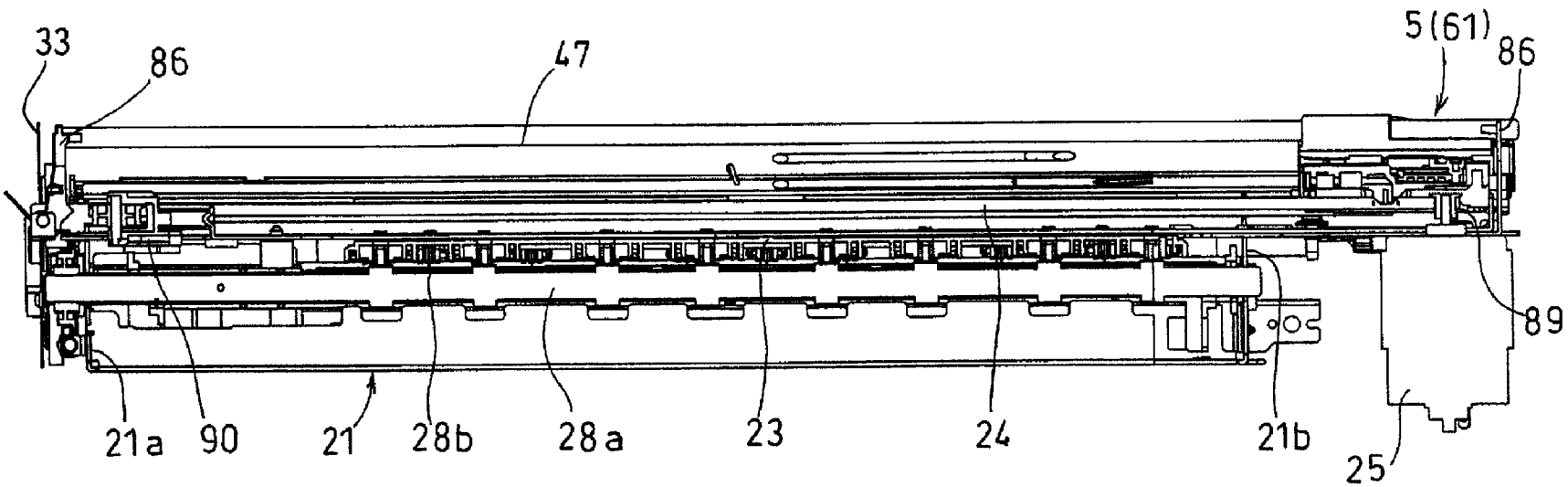
FIG. 7 is a view from the VII-VII line of FIG. 5.
Figure 8:
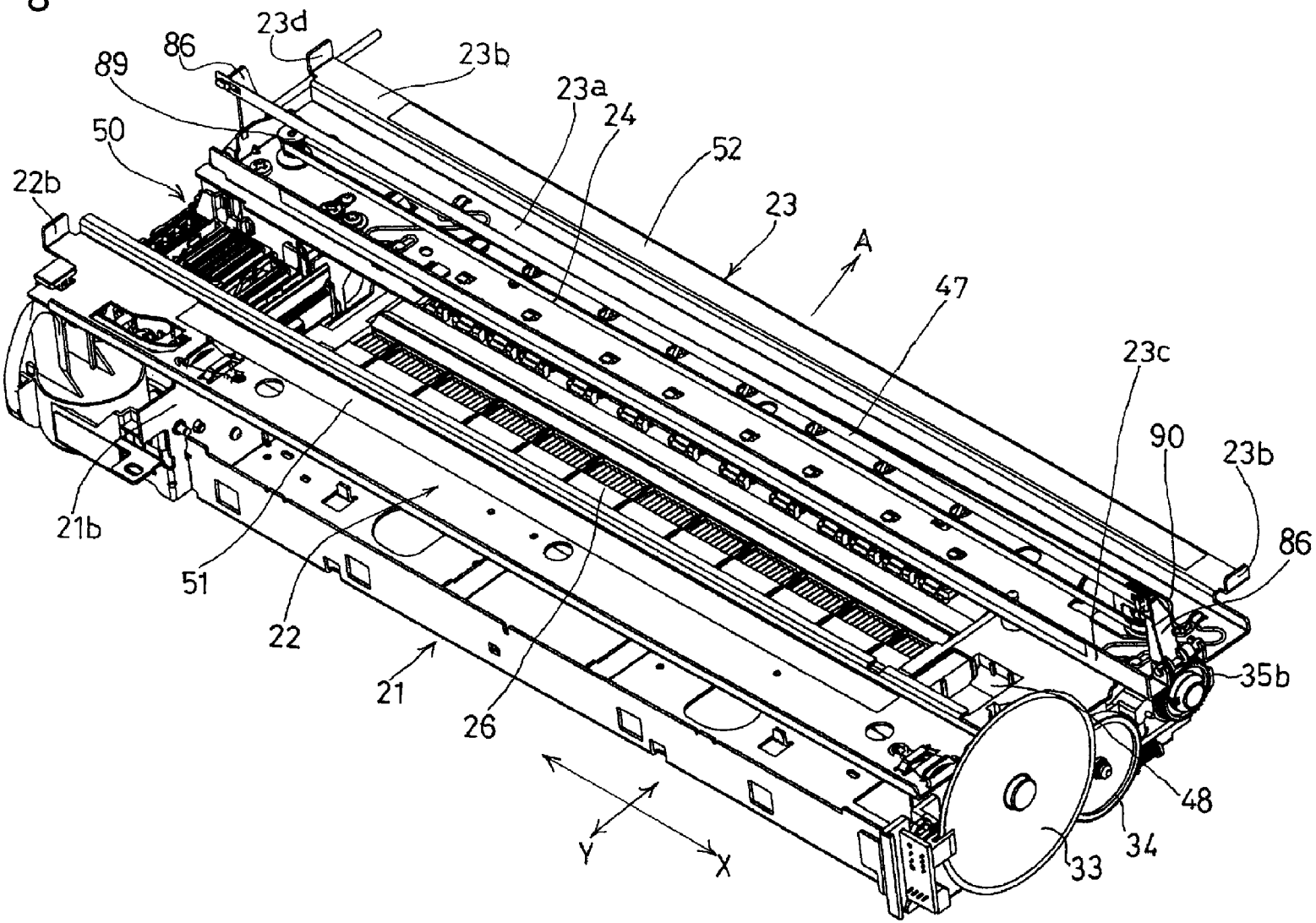
FIG. 8 is an overall perspective view of the recording section excluding a carriage 5.

FIG. 5 is a plan view of the recording section 7, FIG. 6 is a perspective view thereof, FIG. 7 is a view from the VII-VII line of FIG. 5, and FIG. 8 is an overall perspective view of the recording section 7 excluding the carriage 5. The first guide member 22 on the upstream side of the paper transport direction and the second guide member 23 on the downstream side are arranged so that they are substantially parallel during normal use of the image recording apparatus 1. In the first guide member 22, a flat plate section 22*a* having a first slide surface 51 for supporting the rear end of the carriage 5 to be horizontally slidable and a cut-and-raised piece 22*b* with a Z-shaped side surface fitted in a fitting recess section 70 (see FIG. 15) in the front end of a holder body 61 (see FIG. 9) of the carriage 5 are integrally formed.

The second guide member 23 comprises a horizontal wide piece 23*a* for use as a reference surface in the vertical direction (Z-axis direction) in mounting the timing belt 24, the carriage motor 25, an encoder strip 47 for detecting the position of the carriage 5 in the moving direction (X-axis direction) and the moving speed in the same direction; a flat plate section 23*b* having a second slide surface 52 for supporting the front end of the carriage 5 to be horizontally slidable with the horizontal wide piece 23*a* therebetween; and a substantially vertical guide piece (support piece) 23*c* which is bent upward on the upstream side of the horizontal wide piece 23*a* in the paper transport direction.

The first slide surface 51 and the second slide surface 52 provided on the first guide member 22 and the second guide member 23, respectively, are formed on the upper surfaces of the respective guide members 22 and 23 so that they are substantially parallel to the lower surface (nozzle surface) of the recording head 4 on the carriage 5. Moreover, formed on the guide piece 23*c* is a third slide surface 54 facing the downstream side in the paper transport direction. The first, second, and third slide surfaces 51, 52 and 54 are linearly long in the X-axis direction.

Figure 9:
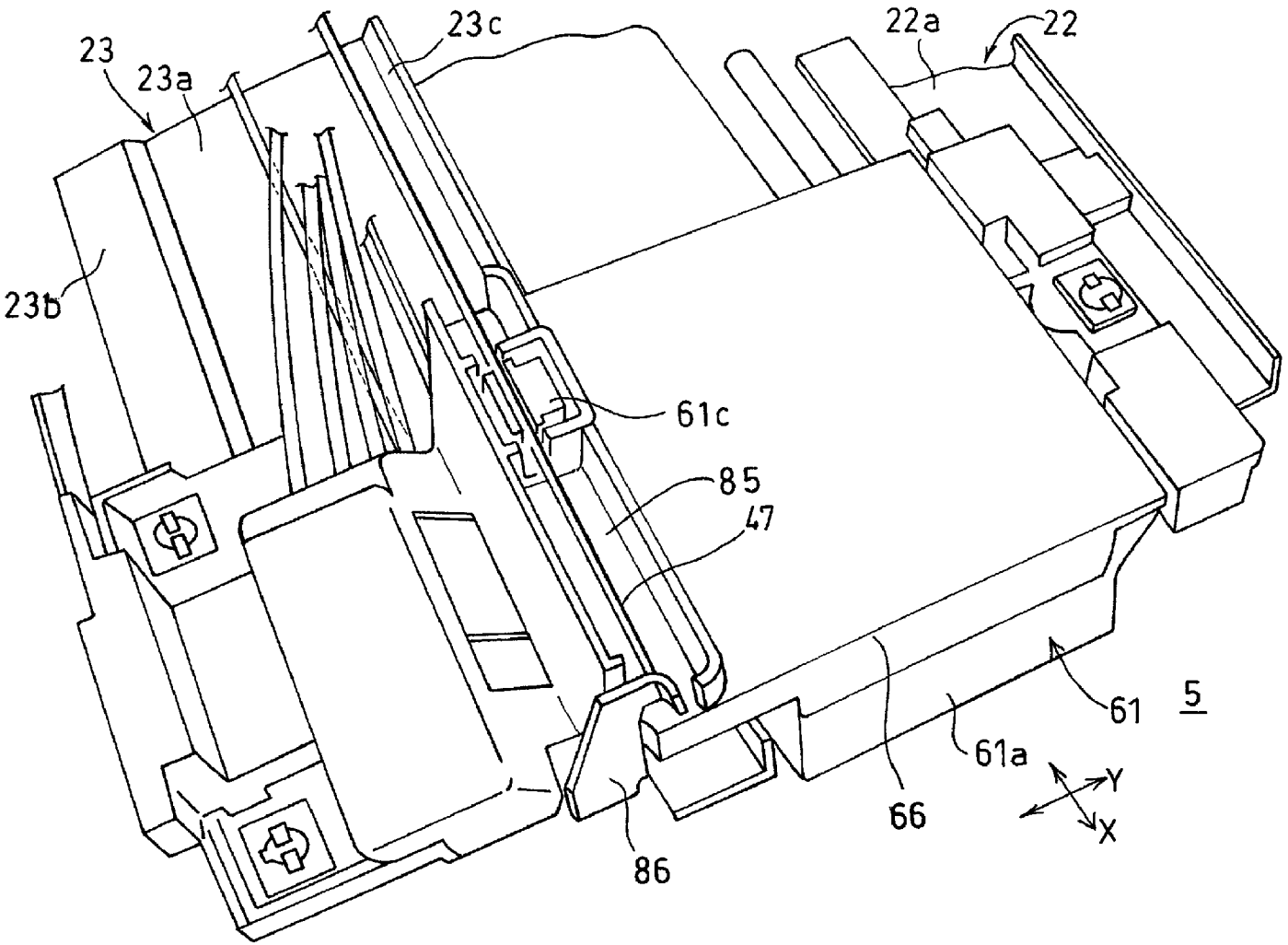
FIG. 9 is a partly enlarged perspective view of the recording section.

FIG. 9 is a partly enlarged perspective view of the recording section 7. The carriage 5 is composed of a synthetic resin holder body 61 having a substantially rectangular shape in the plan view. Formed on the paper transport upstream side of the holder body 61 is a head storing section 61*a* having a large height dimension in a downward direction for storing the recording head 4. An ink channel (not shown) for supplying the ink to the recording head 4 by connecting an end of the ink supply tube 20 on the paper transport downstream side of the holder body 61, a connection support section 61*b* (see FIG. 11) for connecting an end of a flexible flat cable 40, and a guide groove 85 for a light transmitting type sensor (for example, photo-coupler) 61*c* for detecting the position and moving speed by passing the encoder strip 47 therethrough are integrally formed.

The guide groove 85 which is open in the upward direction and also open in the X-axis direction to allow the passage of the encoder strip 47 in the X-axis direction is integrally formed on the upper surface of an upper lid 66 made of a synthetic resin for covering the upper surface of the holder body 61 of the carriage 5. Placed in the middle of the guide groove 85 is the photo-coupler 61*c* capable of passing while sandwiching the encoder strip 47 from the front and rear surfaces thereof. Note that both ends of the encoder strip 47 are placed on a support piece 86 rising from both the left and right ends of the second guide member 23.

A control board (not shown), which outputs a predetermined drive signal to the recording head 4 upon receipt of a signal from the flexible flat cable 40, is provided between the connection support section 61*b* and the upper lid 66 detachable from the upper surface of the holder body 61. Detachment of the upper lid 66 is required to perform maintenance such as replacement of the control board or the ink supply tube 20 as to be described later.

Figure 10:
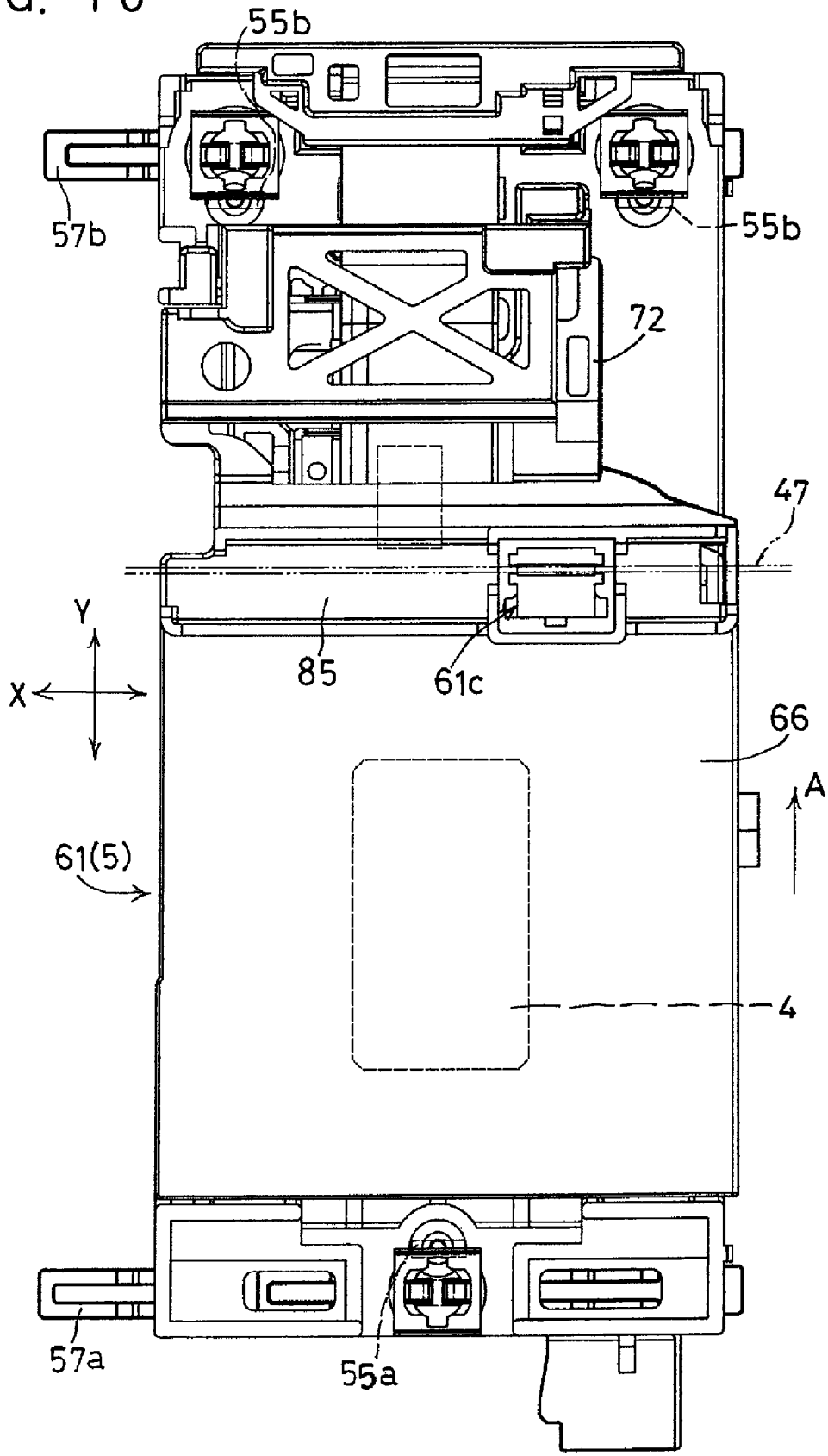
FIG. 10 is a plan view of the carriage.
Figure 11:
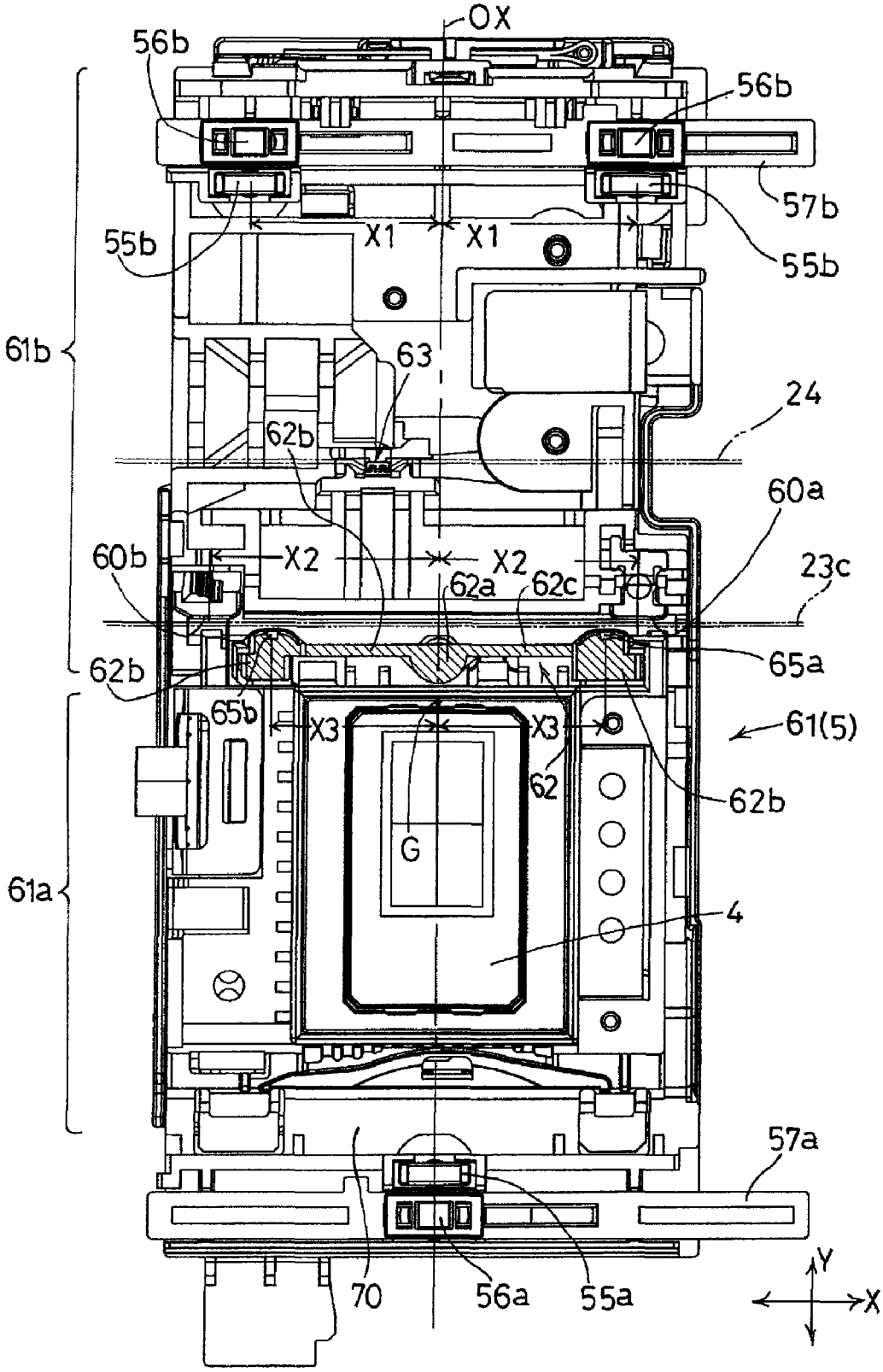
FIG. 11 is a view showing the lower surface of the carriage.

FIG. 10 is a plan view of the carriage 5, and FIG. 11 is a view showing the lower surface of the carriage 5. On the paper transport upstream side of the carriage 5, one first slidable projection section 55*a* that protrudes from the lower surface and comes into contact with the first slide surface 51 of the first guide member 22 is provided near the center of the holder body 61 in the X-axis direction. Moreover, on the paper transport downstream side of the carriage 5, a pair of left and right second slidable projection sections 55*b* that protrudes from the lower surface and comes into contact with the second slide surface 52 of the second guide member 23 are symmetrically arranged about a center line OX in the X-axis direction of the holder main body 61 at a distance of suitable dimension X1 from the center line OX. Therefore, in the plan view of the carriage 5, a shape formed by connecting the respective center points of one first slidable projection section 55*a* and a pair of left and right second slidable projection sections 55*b* and 55*b* is an isosceles triangle. With this structure, the carriage 5 is stably supported with respect to the first and second guide members 22 and 23.

Moreover, a first auxiliary slidable projection section 56*a* is provided adjacent to the first slidable projection section 55*a* on the lower surface of the holder body 61. The first auxiliary slidable projection section 56*a* is arranged so that it selectively protrudes more in a downward direction compared to the lower surface of the first slidable projection section 55*a* when the gap (paper gap) between the nozzle surface and the platen 26 is larger than that in making contact with the first slidable projection section 55*a*. Similarly, second auxiliary slidable projection sections 56*b* are provided adjacent to a pair of second slidable projection sections 55*b* and 55*b*, and arranged so that they selectively protrude more in a downward direction compared to the lower surface of the second slidable projection section 55*b* when the paper gap is increased.

Note that the carriage 5 has a mechanism (not shown) that is selectively raised or lowered more than the lower surfaces of the first auxiliary slidable projection section 56*a* and the second slidable projection sections 55*b*; and function pieces 57*a* and 57*b* that can move reciprocally in the X-axis direction and can appear and disappear. In the case where the carriage 5 is moved along the X-axis direction, when the function pieces 57*a* and 57*b* hit the cut-and-raised pieces 22*b* and 23*d* (see FIG. 5) of the first guide member 22 and second guide member 23 at one moving end and the other moving end, the first auxiliary slidable projection section 56*a* and the second auxiliary protruding section 56*b* are selectively raised or lowered.

Additionally, in the carriage 5, a pair of third slidable projection sections 60*a* and 60*b* that come into contact with the third slide surface 54 formed on the guide piece 23*c* of the second guide member 23 are integrally formed. As shown in FIG. 11, the third slidable projection sections 60*a* and 60*b* are arranged symmetrically about the center line OX in the X-axis direction at a distance of suitable dimension X2 from the center line OX.

Thus, with one first slidable projection section 55 and a pair of left and right second slidable projection sections 55*b* and 55*b* of the carriage 5, the carriage 5 is supported in a triangle shape in the plan view with respect to the first guide member 22 (first slide surface 51) and the second guide member 23 (second slide surface 52). Moreover, since the interval X1 between a pair of left and right second slidable projection sections 55*b* and 55*b* in the X-axis direction is large, the supported posture of the carriage 5 about the Y-axis through the position of center of gravity of the carriage 5 is always stable. In particular, when the carriage 5 starts moving in the main scanning direction (X-axis) direction or when the carriage 5 moves from a stationary state by receiving acceleration, a force trying to rotate the carriage 5 about the Y-axis through a belt joint section 63 due to the function of a component force in the X-axis direction produced by the timing belt 24 can be efficiently received at positions where a pair of second slidable projection sections 55*b* and 55*b* which are separated from each other in the left-and-right direction come into contact with the second slide surface 52. As a result, it is possible to prevent a change in the posture of the carriage 5 about the Y-axis, and it is possible to ensure stable movement of the carriage 5 in the main scanning direction.

In order to increase as much as possible the movable range in the X-axis direction (namely, a recordable area of recording paper in the X-axis direction) while increasing the interval between the two second slidable projection sections 55*b* and 55*b* in the X-axis direction, at least one side of the second guide member 23, and preferably both sides are extended to the outside of the side plates 21*a* and 21*b* along the X-axis direction. Thus, when the carriage 5 stands still at the left end of the recording section 7 (namely, the position facing the ink receiving section 48), the left second slidable projection section 55*b* of the carriage 5 can be positioned at the left end of the second guide member 23 beyond the left side plate 21*a*.

Further, in the carriage 5, a pair of left and right fourth slidable projection sections 65*a* and 65*b* is arranged on the rear surface of the guide piece 23*c*. The pair of fourth slidable projection sections 65*a* and 65*b* is formed on both ends of a clamping body 62 that is a resilient member made of a synthetic resin longitudinally elongated in the left-and-right direction. The pair of fourth slidable projection sections 65*a* and 65*b* is arranged symmetrically about the center line OX in the X-axis direction at a distance of a suitable dimension X3 (<X2<X1) from the center line OX.

The center position in the left-and-right direction of the clamping body 62 is an attachment section 62 with respect to the holder body 61, and the portion between expanded sections 62*b* and 62*b* on the left and right ends has flexibility and serves as a connecting section 62*c* with a small cross section. In each of the expanded sections 62*b* and 62*b*, a compression coil spring, not shown, is placed. With energizing forces of the compression coil springs, the guide piece 23*c* is clamped and resiliently supported by the clamping body 62 and the third slidable projection sections 60*a* and 60*b*. Note that the space between the clamping body 62 and the third slidable projection sections 60*a* and 60*b* is open in the main scanning direction (X-axis direction) and a downward direction (Z-axis direction).

On the lower side of the carriage 5, the belt joint section 63 to which a part of the timing belt 24 is joined is provided between the second slidable projection section 55*b* and the third slidable projection section 60*a* (60*b*) in the sub-scanning direction (Y-axis direction). This belt joint section 63 is provided on the lower surface of the connection support section 61*b*, and has a groove section which is open on the lower surface side of the carriage 5 and both sides of the main scanning direction so that the timing belt 24 is fitted into the belt joint section 63.

As shown in FIG. 11, a pair of left and right third slidable projection sections 60*a* and 60*b* of the carriage 5 come into contact with the third slide surface 54 of the guide piece 23*c* in the vertical direction of the second guide member 23 at a large interval X2 from the center line OX in the X-axis direction of the carriage 5. Moreover, in FIG. 11, a pair of fourth slidable projection sections 65*a* and 65*b* formed on both ends of the clamping section 62 is arranged symmetrically about the center line OX in the X-axis direction at a distance of dimension X3 from the center line OX, and pushes resiliently from the rear surface of the guide piece 23*c*. Therefore, a force trying to rotate the carriage 5 about the Z-axis through the center of gravity G due to the function of a component force F4 in the X-axis direction produced by the timing belt 24 when the carriage 5 starts moving in the main scanning direction (X-axis direction) (or when the carriage moves from a stationary state by receiving acceleration) can be efficiently received at the positions of a pair of left and right third slidable projection sections 60*a* and 60*b* which are separated from each other in the left-and-right direction, a pair of fourth slidable projection sections 65*a* and 65*b*, and the third slide surface 54. As a result, it is possible to prevent a change in the posture of the carriage 5 about the Z-axis, and it is possible to ensure stable movement of the carriage 5 in the main scanning direction.

Figure 12:
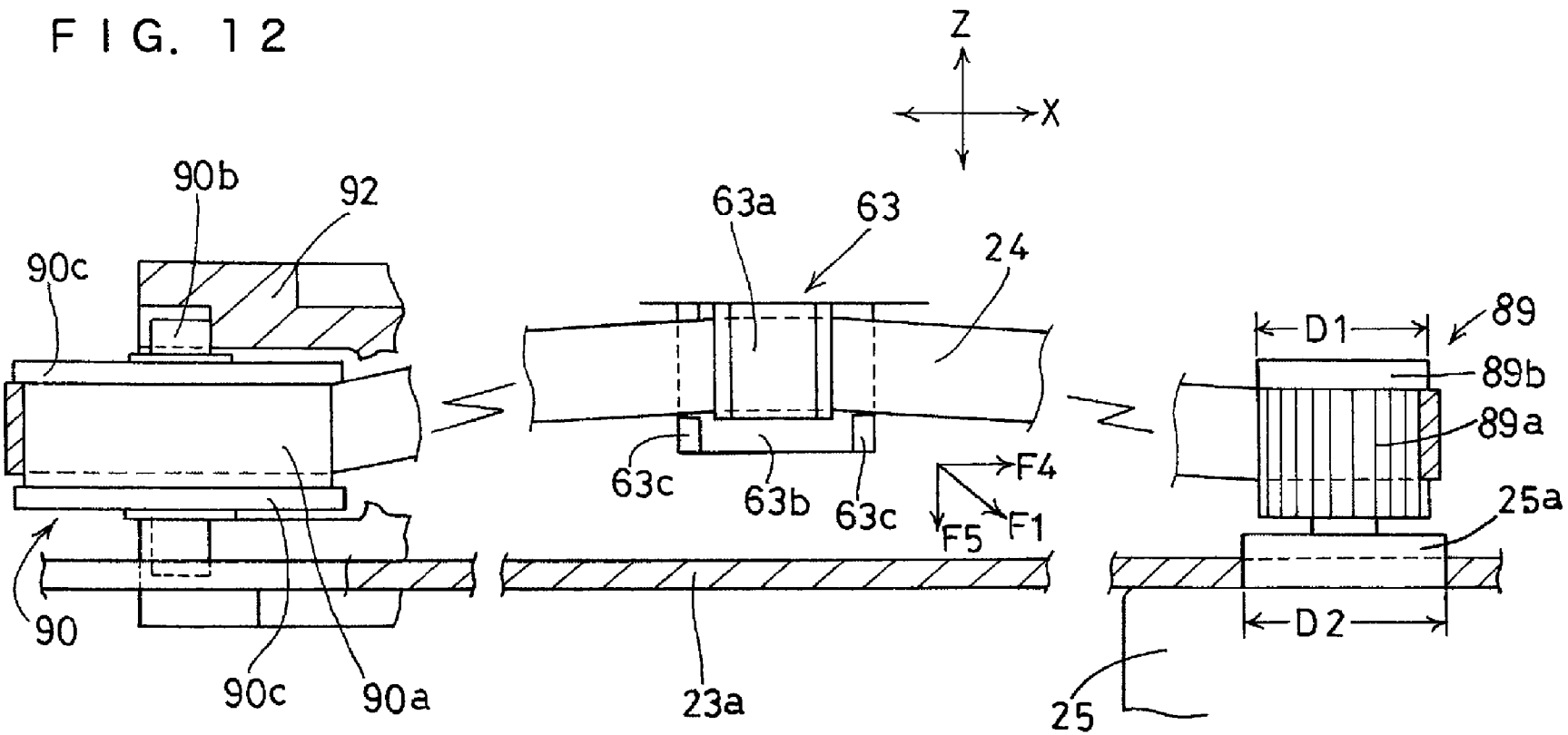
FIG. 12 is an explanatory view showing the connection state of an endless belt to the carriage.

FIG. 12 is an explanatory view showing the joined state of the endless belt 24 to the carriage 5. As described above, the endless belt 24 is wound around the drive pulley 89 and the driven pulley 90. A maximum diameter D1 of the drive pulley 89 fitted on the drive shaft 25*b* protruding from a neck section 25*a* of the carriage motor 25 is made smaller than a diameter D2 of the neck section 25*a*. In a state in which the drive pulley 89 is installed and fixed on the drive shaft 25*b* beforehand, the drive pulley 89 and the neck section 25*a* are inserted from a lower direction into a mount hole which is formed in the horizontal wide piece 23*a* of the second guide member 23 and has a diameter equal to the diameter D2 of the neck section 25*a*. Next, the drive motor 25 is fixed by fastening a screw (not shown) from the upper surface of the horizontal wide piece 23*a*.

Thus, by making the maximum diameter D1 of the drive pulley 89 smaller than the diameter D2 of the neck section 25*a* of the drive motor 25 and forming the mount hole 23*b* substantially equal to the diameter D2 of the neck section 25*a* in the second guide member 23, it is possible to fit the drive pulley 89 on the drive shaft 25*b* before attaching the carriage motor 25 to the second guide member. Moreover, in the horizontal wide piece 23*a* of the second guide member 23, since it is only necessary to form the mount hole for mounting the drive motor 25, the mechanical strength of the second guide member 23 is not decreased to an extreme degree. Further, it is possible to place the drive pulley 89 extremely close to the neck section 25*a* compared with a mount structure in which the horizontal wide piece 23 is positioned between the neck section 25*a* and the drive pulley 89. Further, a tooth flank 89*a* is formed on the circumferential surface of the drive pulley 89 to prevent the timing belt 24 from slipping when the carriage motor 25 is rotated. In addition, on the top end of the drive pulley 89, a flange section 89*b* for preventing disengagement of the timing belt 24 is integrally formed.

The driven pulley 90 comprises a pulley section 90*a* around which the timing belt 24 is wound, a shaft section 90*b* protruding in the rotation axis direction from the pulley section 90*a*, and a large-diameter flange section 90*c* for preventing the both edges in the width direction of the timing belt 24 from being disengaged in the direction of shaft section 90*b*, which are integrally formed from a synthetic resin material. The driven pulley 90 resiliently energizes a rotatably supported holder 92 in the direction of separating from the drive pulley 89.

The positions of the drive pulley 89 and driven pulley 90 are biased so that the direction in which a side piece of the timing belt 24 wound around the drive pulley 89 and driven pulley 90, which is joined and fixed to the carriage 5, is stretched is substantially parallel to the vertical guide piece 23*c* of the second guide member 23, and that a minimum distance from the axial center (rotation center) of the drive pulley 89 to the guide piece 23*c* is smaller than a minimum distance from the axial center (rotation center) of the driven pulley 90 to the guide piece 23*c*. In this structure, when moving the carriage 5 in the main scanning direction (X-axis direction), it is possible to tug the carriage 5 parallel to the guide piece 23*c*, and therefore the carriage 5 moves stably along the third slide surface 54, and the image recording performance is improved. In this case, by placing the large-diameter driven pulley 90 apart from the guide piece 23*c*, it is possible to decrease the width dimension of the second guide member 23 in the paper transport direction and reduce the size of the overall apparatus.

Moreover, it is preferred to set the positional relationship of the belt joint section 63 of the carriage 5 with respect to the drive pulley 89, driven pulley 90 and timing belt 24 so that a component of force (component force) of tension of the timing belt 24 acts in the direction of pushing both the flat plate section 23*b* and guide piece 23*c* of the second guide member 23 of the carriage 5. As will be described later, this structure stabilizes the movement of the carriage 5.

Specifically, in order to push the carriage 5 against the guide piece 23*c* as a vertical piece, the minimum distance from the belt joint section 63 of the carriage 5 and the timing belt 24 to the third slide surface 54 of the guide piece 23*c* is set larger than the minimum distance in the winding section of the timing belt 24 around the drive pulley 89 and the driven pulley 90. In this structure, among the component forces of tension with respect to the timing belt 24 in the belt joint section 63, a component force in the Y-axis direction orthogonal to a direction (X-axis direction) in which the guide piece 23*c* is extended pushes the carriage 5 against the third slide surface 54 of the guide piece 23 located on the side where the timing belt 24 is placed, thereby stabilizing the posture of the carriage 5 being moved and improving the image recording performance.

On the other hand, the height position of the belt joint section 63 of the carriage 5 with respect to the timing belt 24 is biased upward compared to the height position of the winding section of the timing belt 24 around the drive pulley 89 and driven pulley 90. In this case, in the belt joint section 63, the lower edge of the timing belt 24 fitted and held between blocks 63*a* and 63*b* is engaged with a pair of engagement claw sections 63*c* and 63*c* protruding from both ends of the lower edge of the block 63*b* to prevent the timing belt 24 from dropping down, and the upper edge of the timing belt 24 is controlled by the flange section 89*b* at the top of the drive pulley 89 to prevent the timing belt 24 from being disengaged in an upward direction. The upper edge of the timing belt 24 is also controlled by the upper flange section 90*c* of the driven pulley 90 to prevent the timing belt 24 from being disengaged in an upward direction.

If the height position of the belt joint section 63 is set at a higher position than the mount section (the drive pulley 89 and driven pulley 90) of the timing belt 24 with respect to the second guide member 23, a component force F5 in the vertical direction of the tension of the timing belt 24 acts on the carriage 5 at the position of the belt joint section 63 of the carriage 5 particularly when the carriage 5 starts moving in the main scanning direction (when the carriage 5 moves from a stationary state by receiving acceleration). In this case, torque trying to rotate the carriage 5 about the center of gravity G can be efficiently received at the position of the second slidable projection section 55*b* (second slide surface 52). As a result, it is possible to prevent a change in the posture of the carriage 5 about the X-axis through the center of gravity G, and it is possible to ensure stable movement of the carriage 5 in the main scanning direction.

Figure 13:
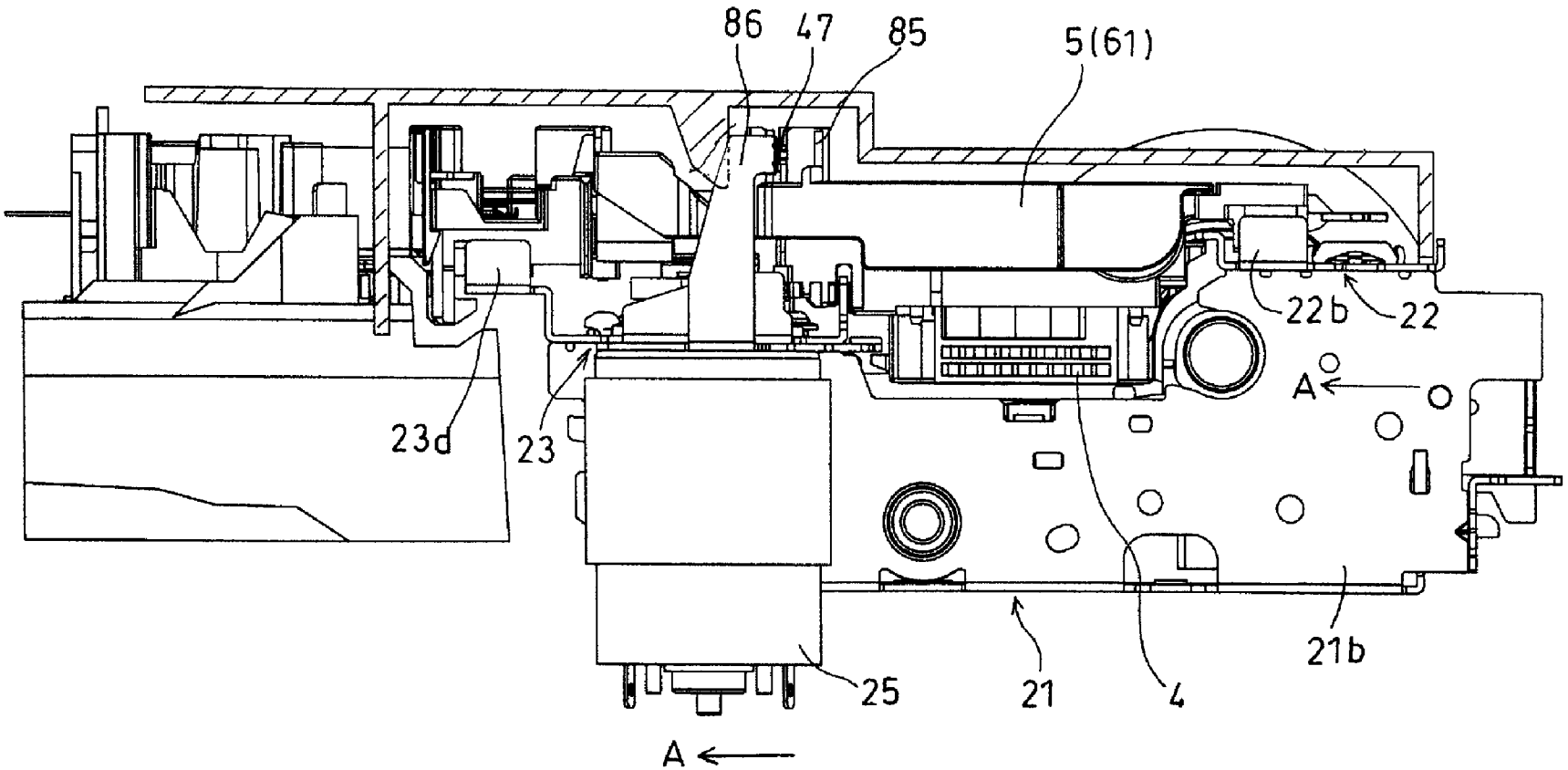
FIG. 13 is a view from the XIII-XIII line of FIG. 5.
Figure 14:
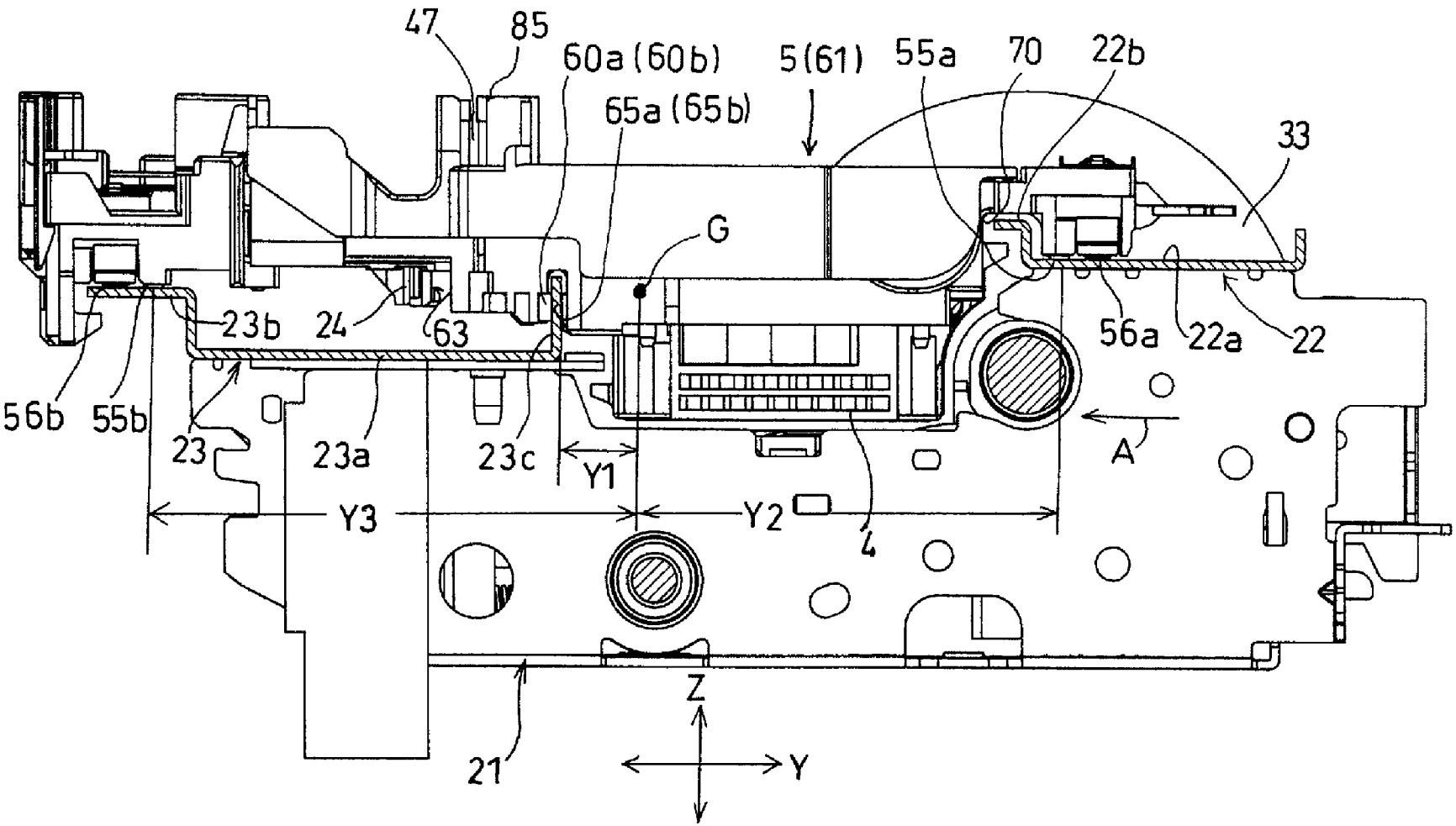
FIG. 14 is a view showing a cross section along the IXV-IXV line of FIG. 5.
Figure 15:
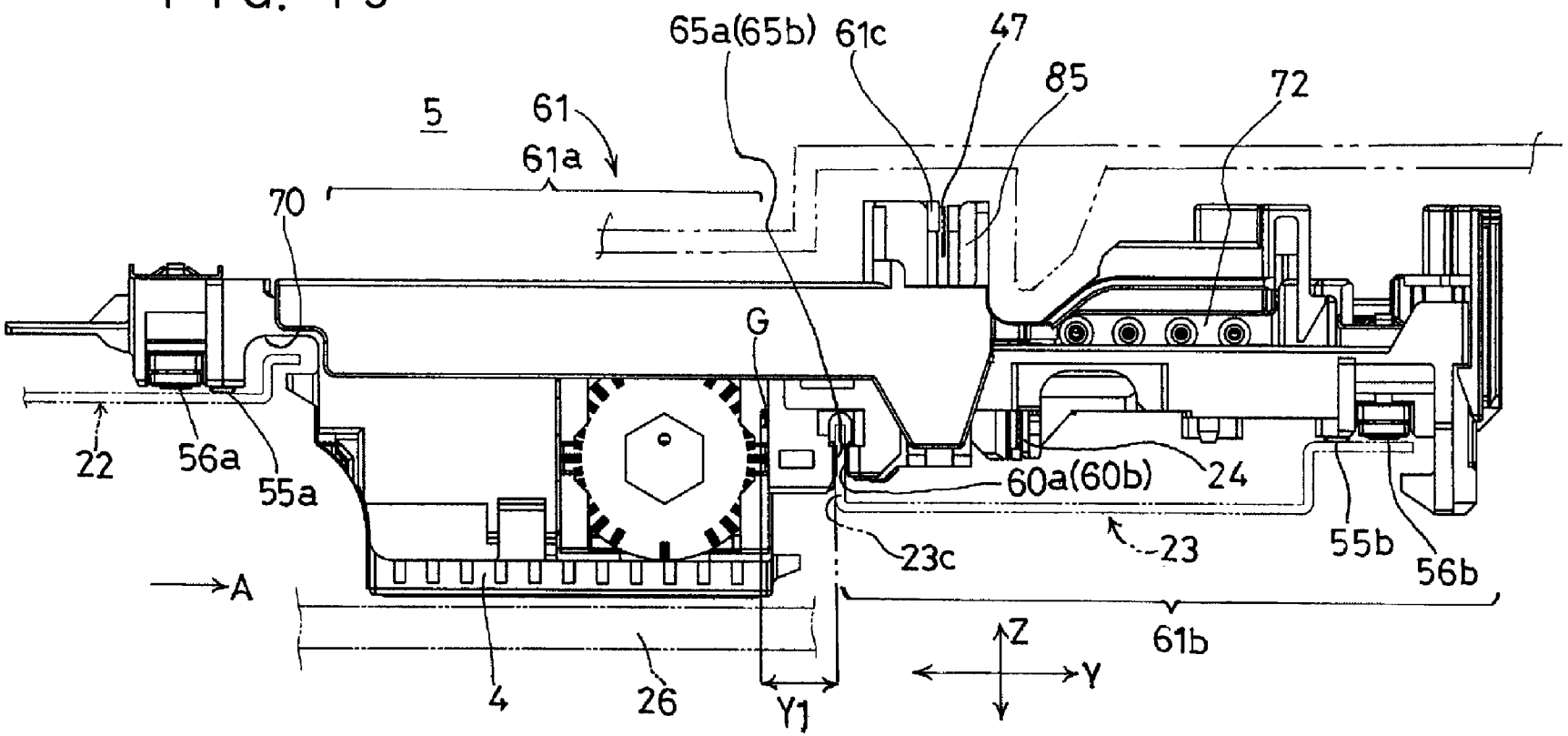
FIG. 15 is a left side view of the carriage, first guide member and second guide member.

FIG. 13 is a view from the XIII-XIII line of FIG. 5, FIG. 14 is a view showing a cross section along the IXV-IXV line of FIG. 5, and FIG. 15 is a left side view of the carriage 5, first guide member 22 and second guide member 23. In this embodiment, the center of gravity G of the entire carriage 5 with respect to the X-axis (the left-to-right width direction of the carriage 5) is on the center line OX in the X-axis direction shown in FIG. 11. With respect to the Y-axis direction, as shown in FIG. 14, it is on a position in the head storing section 61*a* of the carriage 5 where the distance Y1 from the fourth slidable projection sections 65*a* and 65*b* along the Y axis is short. Moreover, the height position of the center of gravity G of the entire carriage 5 with respect to the Z-axis direction (vertical direction) is at substantially the same height position as the second slidable projection section 55*b* (second slide surface 52) and/or the fourth slidable projection sections 65*a* and 65*b*. Further, the height position of the center of gravity G of the carriage 5 is at substantially the same height position as the height position of the belt joint section 63 in the Z-axis direction (vertical direction), and more specifically, the height position of the center of gravity G is set within the width dimension of the timing belt 24. In this structure, even when the carriage 5 starts moving in the main scanning direction (even when the carriage 5 receives the influence of acceleration), a moment about the Y axis through the center of gravity of the carriage 5 can be supported by the second slidable projection section 55*b*. As a result, it is possible to ensure stable movement of the carriage 5 in the main scanning direction with respect to the torque of the carriage 5 about the Y-axis through the center of gravity G.

In this embodiment, among the component force F4 in the X-axis direction and component force F5 in the Z-axis direction of tension F1 with respect to the timing belt 24 in the belt joint section 63, the component force F5 in the Z-axis direction and the self weight of the carriage 5 act in a downward direction along the (vertical) Z-axis on the first slide surface 51 of the first guide member 22 and the second slide surface 52 of the second guide member 23 through the first slidable projection section 55*a* and the second slidable projection section 55*b*. As shown in FIG. 14, since the distance Y2 from the center of gravity G of the carriage 5 to the first slidable projection section 55*a* along the Y axis and similarly the distance Y3 to the second slidable projection section 55*b* are large, even when the carriage 5 is stationary and even when the carriage 5 is moved in the X-axis direction (main scanning direction) at a fixed speed, the carriage 5 can be stably supported by the first guide member 22 and second guide member 23 through the first slidable projection section 55*a* and the second slidable projection section 55*b* which are largely spaced from each other along the Y axis, and the gap dimension (PG) between the lower surface of the recording head 4 carried on the carriage 5 and the paper P on the platen 26 is stabilized. Consequently, the image recording performance is improved.

Moreover, a plurality of ink supply tubes 20 capable of being curved for supplying the inks from the ink storing section 15 provided at a stationary position of the apparatus main body 2 are connected to one side (connection support section 61*b*) facing the X-axis direction of the carriage 5. When a position (tube connection section 72) where the ink supply tubes 20 are connected to the carriage is located between the first slidable projection section 55*a* and the second slidable projection section 55*b* in the Y-axis direction, a load in the vertical (Z-axis) direction is applied to the connection section (connection support section 61*b*). A moment about the X-axis through the center of gravity G of the carriage 5 caused by the load can also be supported on the second slidable projection section 55*b* (second slide surface 52). As a result, it is possible to prevent a change in the posture of the carriage 5 about the X-axis through the center of gravity G, and it is possible to ensure stable movement of the carriage 5 in the main scanning direction.

In the Y-axis direction, a position (tube connection section 72) where the ink supply tubes 20 are connected to the carriage is located between the second slidable projection section 55*b* and the third slidable projection sections 60*a* and 60*b*. In other words, since the tube connection section 72 is located in the third slidable projection sections 60*a* and 60*b* near the belt joint section 63, a moment about the X axis through the center of gravity G of the carriage 5 caused by a load when the ink supply tubes 20 are connected can also be supported by the second slidable projection section 55*b* (second slide surface 52). As a result, it is possible to prevent a change in the posture of the carriage 5 about the X-axis, and it is possible to ensure stable movement of the carriage 5 in the main scanning direction.

Further, the position of the belt joint section 63 in the carriage 5 along the Y-axis direction is also located between the first slidable projection section 55*a* (first slide surface 51) and the second slidable projection section 55*b* (second slide surface 52). Therefore, a force trying to rotate the carriage 5 about the X-axis due to the function of the component force F5 in the Z-axis direction produced by the timing belt 24 particularly when the carriage 5 starts moving in the main scanning direction (X-axis direction) (when the carriage moves from a stationary state by receiving acceleration) can be efficiently received at the positions of the first slidable projection section 55*a* (first slide surface 51) and the second slidable projection section 55*a* (second slide surface 52). As a result, it is possible to prevent a change in the posture of the carriage 5 about the X-axis, and it is possible to ensure stable movement of the carriage 5 in the main scanning direction.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. An image recording apparatus comprising:

a carriage carrying a recording head for recording an image on a recording medium transported in a predetermined direction;

first and second support members, disposed on an upstream side and a downstream side, respectively, in a transport direction of the recording medium, for supporting said carriage slidably by support surfaces thereof facing said recording head, wherein said first and second support members are joined with a pair of side plates extending in the transport direction, and at least one side of said second support member is extended to an outside of said side plate along a moving direction of said carriage; and an endless belt, joined to said carriage, for moving said carriage reciprocally in a direction substantially orthogonal to the transport direction, wherein said carriage comprises a first contact section that comes into contact with the support surface of said first support member, and a second contact section that comes into contact with the support surface of said second support member, and a height position of a joint section of said endless belt and said carriage is at substantially the same height as a position of center of gravity of said carriage.

2. The image recording apparatus according to claim 1, wherein a position of center of gravity of said carriage is present within a width of said endless belt.

3. The image recording apparatus according to claim 1, wherein said second support member has a mount section for mounting said endless belt, and the height position of the joint section of said endless belt and said carriage is higher than the mount section.

4. The image recording apparatus according to claim 3, wherein said second support member has two of the mount section at two positions spaced from each other in a moving direction of said carriage.

5. The image recording apparatus according to claim 1, wherein two of the second contact section are provided at two positions spaced from each other in a moving direction of said carriage, and the joint section of said endless belt and said carriage is located between said two of the second contact section.

6. The image recording apparatus according to claim 5, wherein height positions of the two second contact sections and the position of center of gravity of said carriage are at substantially same height.

7. The image recording apparatus according to claim 5, wherein the first contact section and the two second contact sections are positioned on vertexes of a triangle straddled over said first and second support members.

8. The image recording apparatus according to claim 1, further comprising a support piece, provided on the downstream side of said second support member that it stands substantially orthogonally to the support surface of said second support member, wherein said carriage comprises a third contact section that comes into contact with one surface of said support piece, a fourth contact section that comes into contact with the other surface of said support piece at an opposite position to the third contact section, and a resilient member for pressing the fourth contact section toward the third contact section, and the joint section of said endless belt and said carriage is located between the second contact section and the third contact section in the transport direction.

9. The image recording apparatus according to claim 8, wherein two pairs of the third and fourth contact sections are arranged with a distance therebetween in a moving direction of said carriage.

10. The image recording apparatus according to claim 8, further comprising:

an ink storing section for storing ink; and a flexible ink supply tube for supplying the ink in said ink storing section to said recording head, wherein said carriage has a connection section with respect to said ink supply tube to enable supply of the ink from the ink supply tube, which is connected to said connection section, to said recording head, and said connection section is located between said first contact section and said second contact section in the transport direction.

11. The image recording apparatus according to claim 10, wherein said connection section is located between the second contact section and the third contact section in the transport direction.

12. The image recording apparatus according to claim 10, wherein said ink storing section is capable of storing inks of a plurality of colors, and includes the same number of the ink supply tubes as the number of colors of inks stored in said ink storing section.

13. The image recording apparatus according to claim 1, wherein the height position of the support surface of said second support member is located within a width of said endless belt.

14. The image recording apparatus according to claim 1, further comprising:

an ink storing section for storing ink; and a flexible ink supply tube for supplying the ink in said ink storing section to said recording head, wherein said carriage has a connection section with respect to said ink supply tube to enable supply of the ink from the ink supply tube, which is connected to said connection section, to said recording head, and said connection section is located between said first contact section and said second contact section in the transport direction.

15. The image recording apparatus according to claim 14, wherein said ink storing section is capable of storing inks of a plurality of colors, and includes the same number of the ink supply tubes as the number of colors of inks stored in said ink storing section.

16. The image recording apparatus according to claim 1, wherein a platen facing said recording head is provided between said pair of side plates.

* * * * *